United States Patent [19]

Watts

[11] 4,033,588

[45] July 5, 1977

[54] AUTOMATIC KENO GAME

[76] Inventor: James P. Watts, 6930 E. Pinchot Ave., Scottsdale, Ariz. 85251

[22] Filed: June 16, 1975

[21] Appl. No.: 587,101

[52] U.S. Cl. ..... 273/138 A; 235/61.7 R; 235/61.9 R

[51] Int. Cl.² ..... A63F 3/06; A06K 3/00

[58] Field of Search ..... 273/139, 138 A, 130 AB, 273/135 B, 1 E; 235/61.7 R, 61.9 R; 194/10

[56] References Cited

UNITED STATES PATENTS

| | | | |
|---|---|---|---|
| 2,996,163 | 8/1961 | Baker, Jr. | 194/10 X |
| 3,242,929 | 3/1966 | Adams | 194/10 X |
| 3,505,646 | 4/1970 | Affel, Jr. et al. | 273/138 A X |
| 3,533,629 | 10/1970 | Raven | 273/138 A |
| 3,786,234 | 1/1974 | Trent et al. | 273/138 A X |
| 3,810,627 | 5/1974 | Levy | 273/138 A |

*Primary Examiner*—Richard C. Pinkham
*Assistant Examiner*—Arnold W. Kramer
*Attorney, Agent, or Firm*—John A. Robertson

[57] ABSTRACT

This invention relates to a numbers game apparatus, among other things, for taking money, giving change, printing and giving out tickets, validating tickets, finding and checking winners, finding out the odds, and determining the amounts won by winning tickets. Apparatus is provided at a plurality of points remote from a central location where the money is taken, change, if any, is given, the amount bet is selected and a ticket is given out printed with, among other information, the numbers bet, the amount of the bet, the number, time, and date of the game, and the remote location. Also, at the remote locations, the winning numbers are posted and the local machine is prevented from accepting bets on a game just prior to numbers being drawn for that game. The ticket validation, the records, and the paying desk including manned payout windows and manned betting windows and of course the machine for drawing numbers is located at the central office or location. Thereby bets may be made on the same game at many locations, easing the line at the central station. Since the remote location is automatic, a great saving in personnel is effected.

6 Claims, 31 Drawing Figures

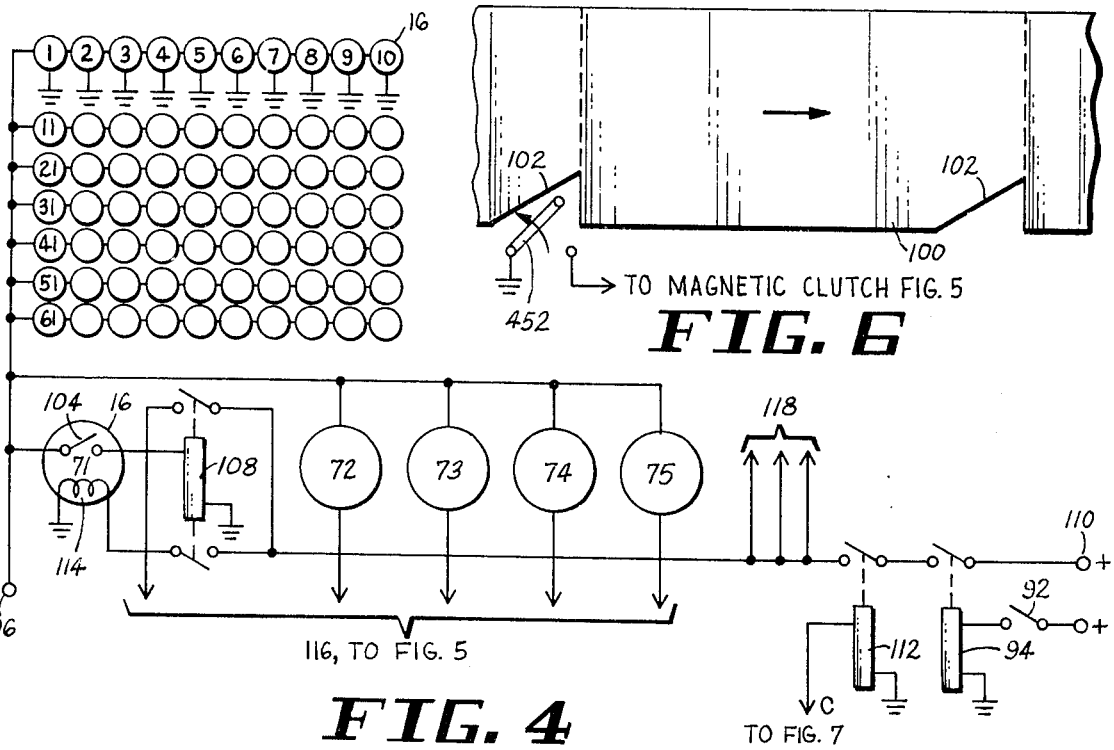
FIG. 6
FIG. 4
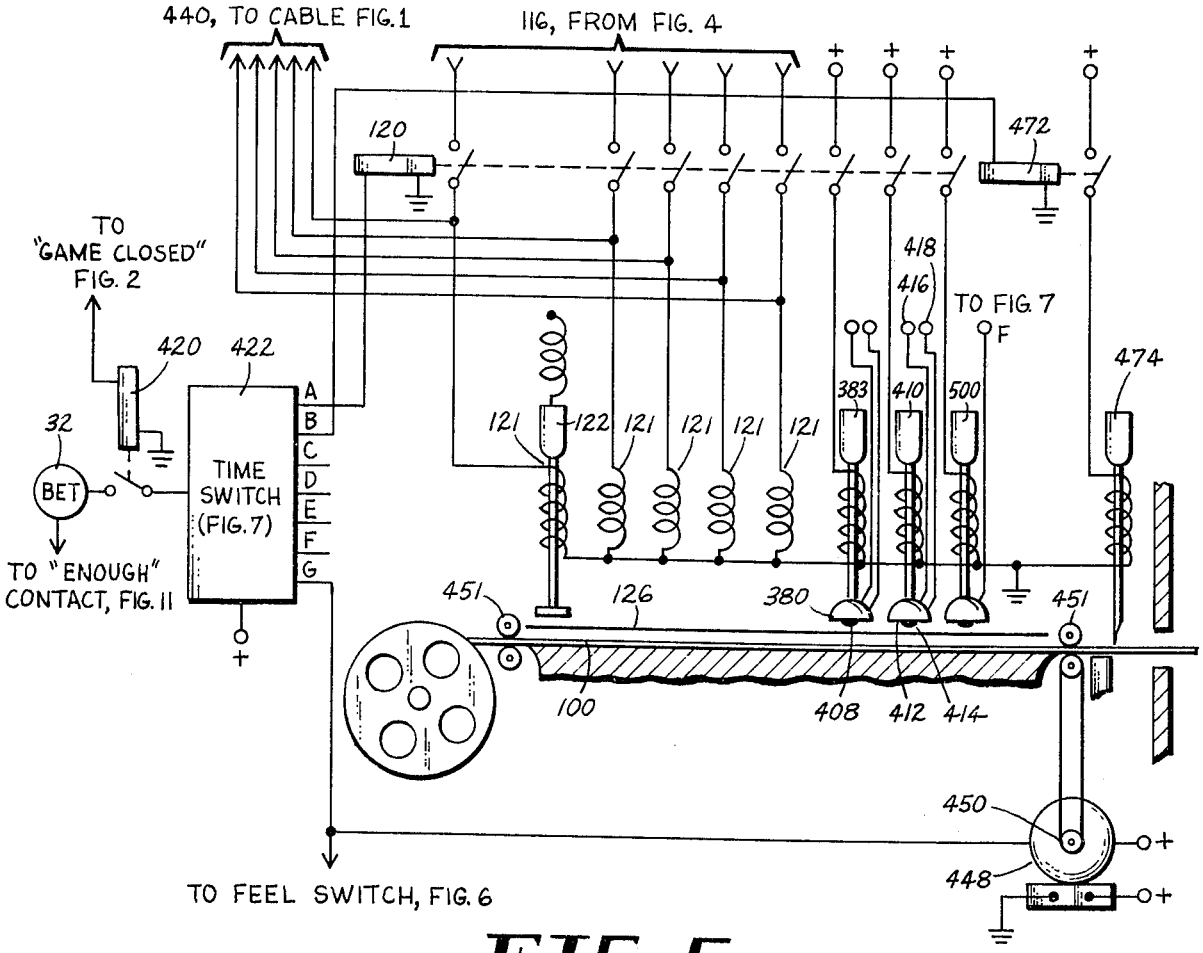
FIG. 5

AUTOMATIC KENO GAME

The present invention relates to numbers games of which Keno is an example and is concerned primarily with a system for such a game which is automated to a high degree.

BACKGROUND OF THE INVENTION

The game of Keno, a numbers game, is well known. In general, a person bets a certain amount of money that certain numbers will come out of a number drawing machine of a possible total and he gets paid in accordance to how many of the numbers that he bets on come out. More explicitly, the person predicts that certain numbers will be drawn by the machine and if one of the bet-on numbers comes out, he gets paid in accordance with a certain odds, the odds depending on how many numbers the person bet on. If two of the bet-on numbers come out, the odds are higher. Similarly, the less numbers he bets on the higher the odds paid him if one or more of the numbers he bets on comes out.

In accordance with the prior art, all betting is done at the central station where the numbers are drawn or a bet is made with the help of one or more Keno persons, usually a girl who walks around the betting establishment. The bettor gets a Keno card from containers at or near the central station or from the Keno girl or from various remote locations. The bettor marks the numbers bet on on the card and gives it to the clerk at the central station or to the Keno girl. The clerk or girl marks another card, similar to the card given him or her, with the same numbers and the amount bet. The cards have on them certain information such as whose game it is, the data and the game number for that date, and usually the hour. The clerk, or girl, keeps the original card for checking purposes as will be explained.

After a period for making bets, the game is closed, that is, no more bets are taken for the game and numbers are drawn, usually twenty at the central location. The bettors flock to the central station where they can observe the numbers that come out and they present the winning cards to pay clerks. First the pay clerk validates the cards, that is he finds the original card given him by the bettor and compares them to see if they are identical. If identical, the clerk counts the number of winning numbers out of the total numbers bet on and finds the odds which is set by the proprietor running the game. This is usually accomplished by looking at an odds sheet which tells what the odds are for the number of winners out of the number of numbers bet on. (It is noted that the order of numbers or the magnitude of the numbers bet on is unimportant. The important point is how many of the numbers bet on came out.)

Then, having found the odds, the amount bet on that game is multiplied by the odds to determine how much the bettor has won. This determination can be made by using a calculating machine, or quite often amounts at odds that frequently occur may be found on one or more sheets.

It will be noticed how much personal attention is required. A clerk or Keno girl must take a duplicate ticket, must accept money, and give change if necessary. He must mark the ticket with the amount bet, the time of the bet, and the number of the game. If a winning ticket is presented, he must validate the ticket, check to see how many numbers came out and how many were bet on. Then he must find the odds and calculate the amount won and pay the ticket holder. The amount of personal attention each bettor gets requires either a great many clerks, or, if the number of clerks is kept at a minimum, the number of bets accepted is reduced on each game, or the number of games played per day is reduced, reducing the number of times the money is turned over and therefore reducing the profits. It can be seen that any way the number of bets per game can be increased, with the number of clerks kept at a minimum, increases the profits.

The paying of winning tickets at the central station is carefully monitored by a supervisor, particularly in those cases when a large amount of money is won. With the now used systems this monitoring consumes a large, if not excessive, amount of time.

OBJECTS OF THE INVENTION

It is an object of this invention to make automatic, as far as possible, the playing of Keno.

It is a further object of this invention to replace Keno girls by machines which will accept money, give change if necessary, give out tickets having the bet-on numbers indicated thereon, retain all information necessary to validate the ticket, check the amount bet, the time of the bet, the date of the bet, and the numbers bet on.

It is a further object of this invention to provide, at the central station, or where desired, apparatus for giving out duplicate tickets upon a hand-filled-in ticket being put into the apparatus.

It is still a further object of this invention to provide apparatus to validate a winning ticket, find the odds, and calculate the amount to be paid to the winner.

In general, it is an object of this invention to automate, to a great extent, the ticket issuing, validating, odds finding and winning amount calculation of Keno.

SUMMARY OF THE INVENTION

In accordance with this invention, apparatus is provided at any of several remote points, which will accept money and give change if necessary, which will print a ticket and present it to the bettor, the ticket having on it the amount bet and the numbers bet on. Other information, such as whose game it is, the date of the game, and the serial number of the ticket may be applied to the tickets when they are put in the apparatus at the beginning of the day. Other information such as the game number, and the time of day may be printed on the ticket.

All pertinent information regarding a ticket may be recorded at a central office point. Further in accordance with this invention, the winning numbers will be displayed at or near each ticket issuing apparatus and wherever desired. The ticket issuing apparatus may be disabled from just before the winning numbers are drawn for a game until all the winning numbers for that game are drawn. The winning numbers of a game may be displayed as long as is desired. Further in accordance with this invention, ticket validating, odds finding, and winnings calculating apparatus may be provided at the central locations where the winning numbers are drawn. Also at the central station, a ticket duplicating apparatus is provided which accepts a ticket filled in by a bettor and gives out a duplicate ticket filled in by machine, the manually filled in ticket being retained for validating purposes.

SHORT DESCRIPTION OF SEVERAL FIGURES

The invention will be better understood upon reading the following detailed description in connection with the accompanying drawings in which:

FIG. 1 illustrates the central station including the number drawing machine, the winning number display, the duplicate ticket issuing machine, the ticket validating apparatus, the odds finding and winnings calculating apparatus; as well as a remote apparatus which accepts money, gives change if necessary, issues a ticket with necessary information thereon and sends such information to the central location. In addition, a display of the winning numbers is provided at the remote apparatus.

FIG. 4 is a diagrammatic view of the numbers selector for the remote cabinet.

FIG. 5 is a diagrammatic view of the ticket printing mechanism.

FIG. 6 is a diagrammatic view of a detail of FIG. 5.

DETAILED DESCRIPTION OF APPARATUS INCLUDING THIS INVENTION

First a general description of the disclosed apparatus will be given in connection with FIGS. 1, 2, and 2A, and then apparatus that provides the several functions of the apparatus will be described in detail. It is noted, as is the usual practice, that the best detailed apparatus now contemplated is diagrammatically illustrated and described, however the claims are not to be limited to the apparatus shown and described but only by the prior art.

The System in General

Figure 1:
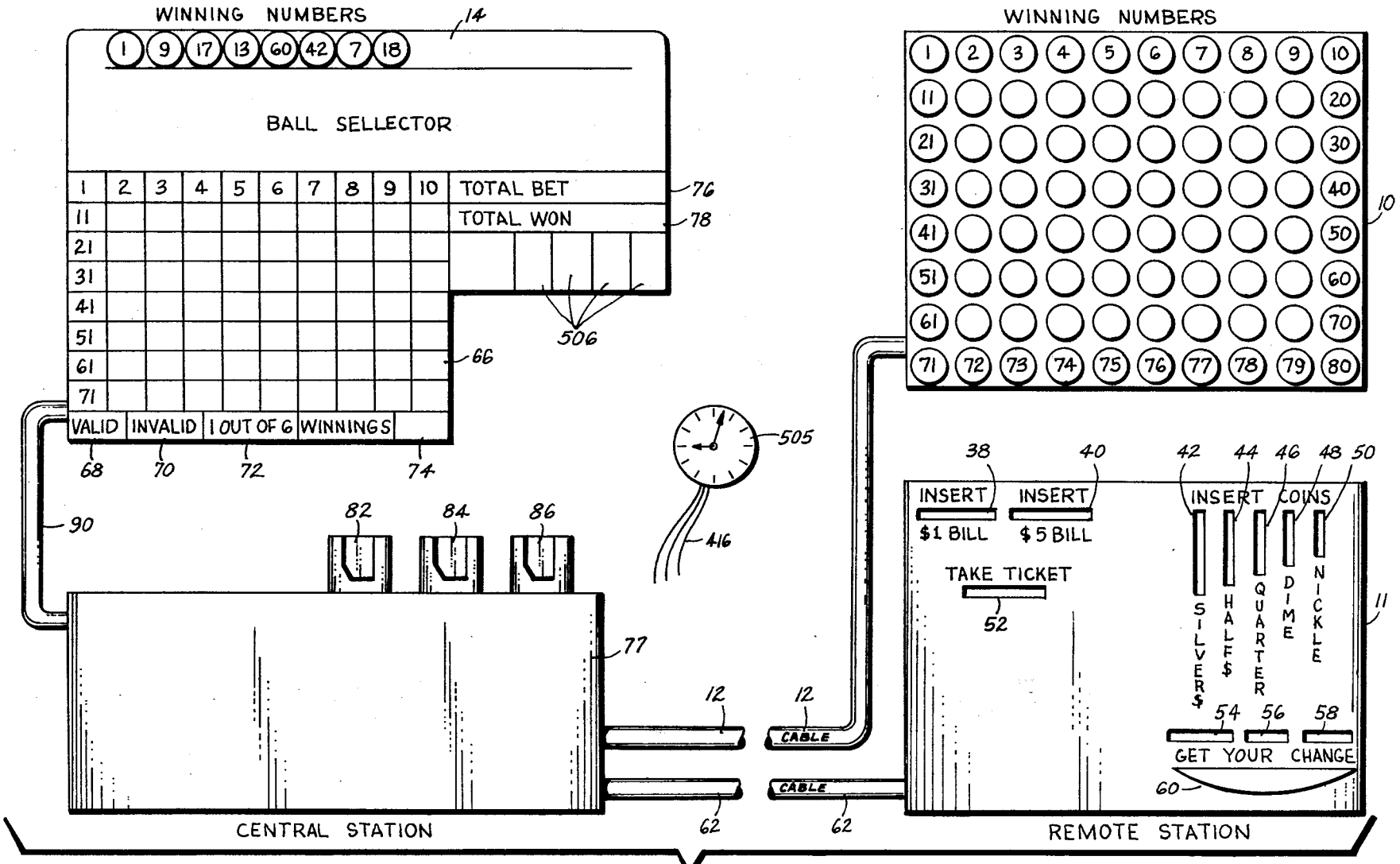

Turning to FIG. 1, a typical layout for the central office and a remote bet-taking, change-giving, ticket-issuing, and winning-number indicating branch are illustrated for a numbers game of the Keno type. In such a game, usually twenty winning numbers are selected in a manner controlled by chance alone out of a possible eighty numbers. The winners are those players who previously, before any number is selected, had purchased a card having one or more of the winning numbers marked thereon. A player may chose any one or more of the eighty numbers. The player may pay any amount that he cares to bet, although there is usually a minimum and a maximum bet and odd cents bets are not usually accepted. The odds are set by the owner of the game and depend on how many numbers the player bets on and how many of the bet-on numbers become winning numbers. If the player chooses, as an example, numbers, none of which become winning numbers, that is "come out," the player loses. If all the numbers he chose come out, the odds depend on the number of numbers he chose. If less than all come out, the player may still win but the odds are lower. Obviously, the odds are set at less than the mathematical odds, to give the owner of the game a margin out of which to pay the expense of the game and a profit.

Figure 2A:
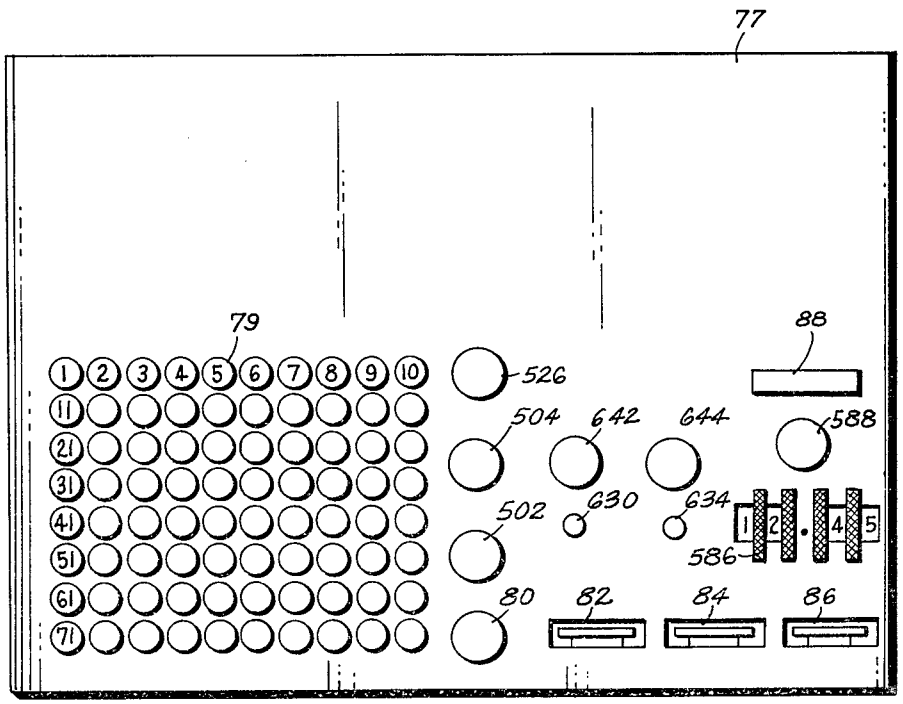
FIG. 2A is a top view of the operator's console or desk.
Figure 2:
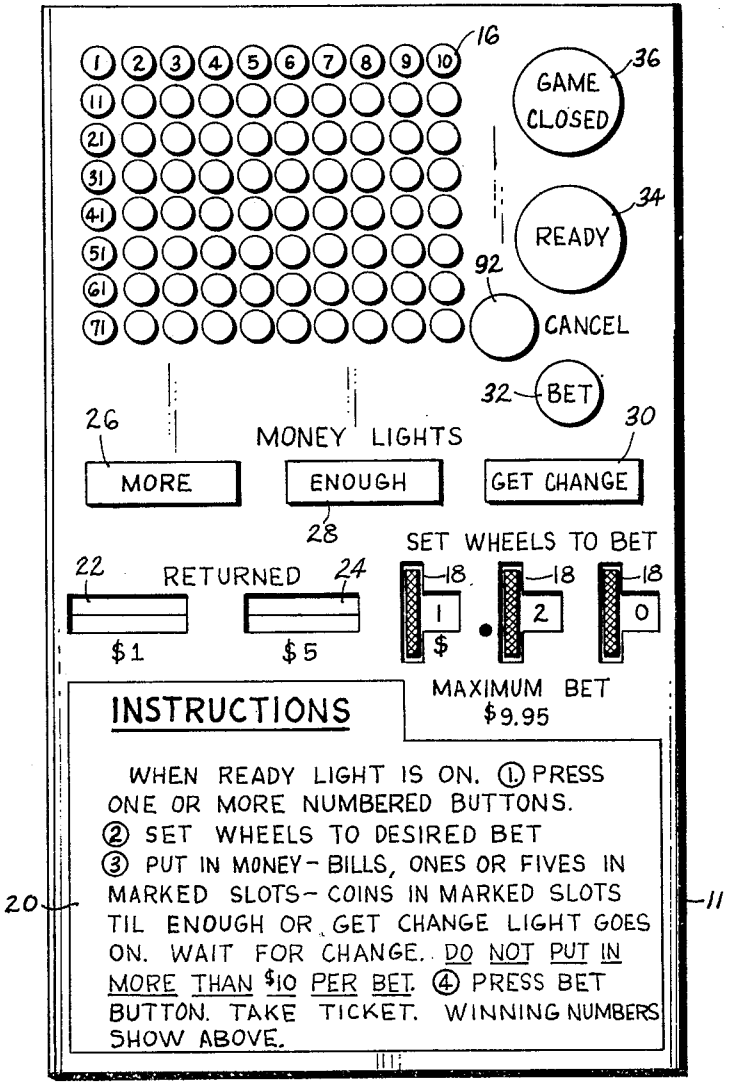
FIG. 2 is a top view of the remote cabinet or console.

At the remote station, see FIGS. 1, 2, and 2A, a display of numbered, illuminatable indicators 10 connected by a cable 12 to the central station, is provided. As will be more fully explained, an operator at the central station will press a button, of the array 79 (FIG. 2A) on his console 77 as each winning number (here shown as 1, 9, 17, 13, 60, 42, 7, 10) comes out of the ball selecting machine 14, each ball having a number thereon. As he does this, the corresponding number of the central display 66 and at each remote display 10 lights up. The numbers stay lit up until the operator presses an "off" button 80 and all displays go off. Usually, however, the winning numbers for each game are preserved for a predetermined length of time to give the bettors time to see if they have won and to assist the winners in collecting their winnings.

Further, at the remote station, on the top of the console 11 (FIG. 2) are provided buttons 16 of the numbers that can be played, and a "cancel" button 92 that permits the bettor to cancel all buttons 16 he has pressed and start over. The top of the console 11 also has wheels 18 that can be set to the desired bet, up to a maximum bet of $9.95, it being noted that by adding a wheel, the bet maximum can be raised to $99.95 as is well known. The top of the remote console 11 also has a place for directions 20, return of $1.00 bills 22 and $5.00 bills 24, and money lights 26, 28, and 30. The top of the remote console further includes a "bet" button 32, a "ready" light 34 and a "game closed" light 36.

The front of the console 11, FIG. 1, has a slot 38 to receive $1.00 bills, a slot 40 to receive $5.00 bills, slots 42 and 50 to receive $1.00, half dollar, quarter, dime, and nickel coins; a slot 52 from which a ticket will issue having printed thereon in magnetic ink the chosen numbers, amount bet, date, game number, proprietor of the game, and if desired, the location of the remote cabinet, the time of day that the ticket was printed, and its serial number. Furthermore, slots 54, 56, and 58 are provided at the front of the cabinet from which a bettor's change is extruded and a cup 60 is provided to catch the change. The console 11 is connected to the central station by a cable 62, although cables 12 and 62 may be combined if the display 10 and the cabinet 11 are at the same location.

The central station is also shown in FIG. 1, the top of the central station console 77 being shown in FIG. 2A. Besides the ball selector machine 14, which is conventional, the central station includes a large display of winning numbers 66, a "valid" and "invalid" light, 68 and 70 respectively, a display 72 of the number of numbers that came out, and of the number of numbers that were bet on, here shown as 1 out of 6. The amount of winnings of the ticket being checked is shown at 74 while the total bet that day is shown at 76 and the total won is shown at 78. If desired, these amounts, or either of them may be behind a blind. Recorders of information from remote consoles 11 may be positioned at any convenient place such as at 506 in FIG. 1. The operator, not shown, presses the corresponding numbered button of the array at 79 as the corresponding ball comes out of the ball selecting machine 14 and the corresponding indicator 66 at the central station and 10 at each of the remote stations, lights up and stays lit up until the operator presses the cancel button 80. A ticket validator 82, an odds and winning calculator 84, and a magnetic ticket printer 86, is provided on the console table as shown in both FIG. 1 and 2A.

As will be noted, the ticket that the bettor hands the attendant or clerk never leaves his sight, at least part of the ticket being visible to the bettor at all times, while a ticket is validated by the use of the validator 82, the winnings are calculated by the calculator 84, or a ticket is issued to the bettor that is a duplicate of the ticket put into the duplicator 86. Then when the duplicate ticket that issues from the slot 88 is given to the bettor, his original ticket is taken from the duplicator 86 and kept as long as appears necesssary. A cable 90, FIG. 1, connects the console 77 to the display 66.

Ticket Printing

Figure 3:
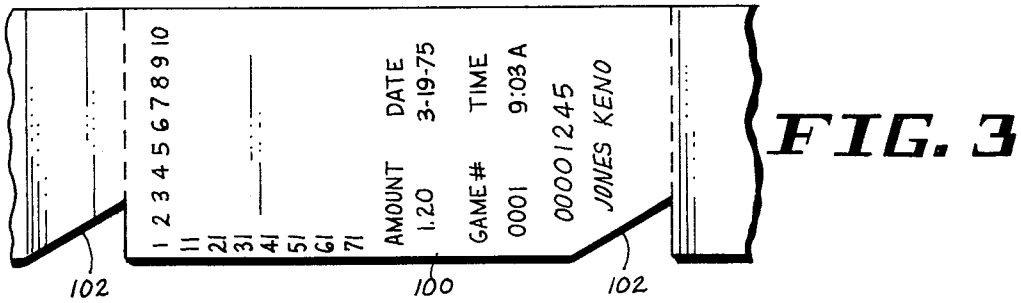
FIG. 3 is an illustration of a ticket and the information shown thereby.
Figure 20:
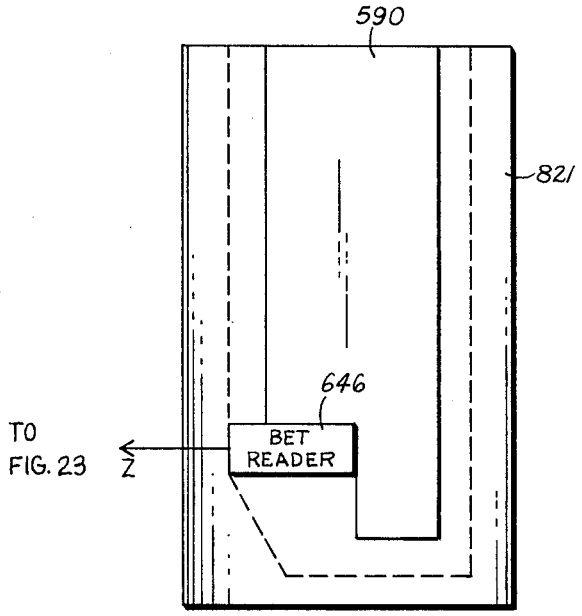
FIG. 20 is an enlarged view of the ticket receiver that is part of the odds determiner and winnings calculator.

At this point each component will be described in connection with its respective illustration. A typical ticket 100 after printing and before being cut from a roll thereof is shown in FIG. 3. The ticket 100 has space near one end, the left as shown in FIG. 3, for the printing or marking of numbers that are bet on. The numbers, as will be explained, will be printed as an array, that is each number has its place and only one number to a place. To make sure that the place is not rendered ambiguous, a notch 102 is cut from each ticket on the roll and when the ticket if validated or the winnings are figured, the ticket 100 is put into the validator 82 or the calculator 84 with the face visible to the bettor and with the notch 102 matching a corner portion as will be more fully described in connection with the description of FIG. 20.

The amount of the bet, here shown as $1.20, the game number, here shown as 0001, and the time of day, here shown as 9:03 am, are printed on the ticket 100 in the positions shown. The proprietor of the game and the date may be printed on the roll of tickets when made or they may be printed on the ticket as part of this operation by an obvious modification of the machine to be described. When a ticket is to be duplicated, a separate ticket will be obtained by the bettor from a pile thereof as will be described.

As stated by the directions 20, a bettor, seeing the "ready" light 34 on, may press any one or more of the buttons 16 on top of the console 11, to indicate the number or numbers that he cares to bet on. Pressing a button 16, as shown in FIG. 4, causes the button that is pressed to become illuminated and, as will be explained, the button remains illuminated until the betting operation is completed. A switch 104 in each button is closed when that button is pressed. Closing the switch 104 causes a circuit from the positive terminal 106 of a suitable source through a relay 108 to ground. The relay closes both sets of contacts.

The upper set, as shown in FIG. 5, upon closing, connects the positive terminal 110, by way of normally closed contacts of relays 94 and 112, the closed upper contacts of the relay 108 to ground. Therefore the relay 108 is continually energized through its closed upper contacts even though the switch 104 was closed only momentarily. The lower contacts of relay 108 are also closed and the bulb 114, which is included in each button, goes on and stays on as long as the relay 108 is energized.

If the bettor changes his mind he may press "cancel" button 92, FIGS. 2 and 4, and relay 94 will open its contacts disconnecting the source 110 from the buttons of the array 16. The bettor may then choose other numbers. A circuit is also completed from the source 110 through the upper contacts of relay 108 to a lead 116 for a purpose to be described. There are eighty buttons 16, each having a bulb therein such as the bulb 114 and each having a holding relay 108 with pairs of contacts connected as described, so for clarity, only one thereof is shown. The source 110 through the normally closed contacts of the relays 92 and 112 feeds all the relays 108 and all the bulbs 114, as indicated by the leads 118, whereby upon energization of the relay 112, as will be described, all the relays 108 are deenergized and all the bulbs 114 go off. It is noted that a lead 116 extends from the junction of each of buttons 16 and each relay 108 to FIG. 5. There are 80 leads 116 but for clarity only five of them are shown.

Turning now to FIG. 5, each lead 116 is connected to a contact of a normally open pair thereof of a relay 120. As understood, for reliable operation, a relay may not have more than about eight pairs of contacts. Since there are eighty leads 116, as well as other contacts to be operated by the relay 120, a tree of relays 120 may be used as is known. This is, the contacts of the relay 120 may each operate another relay such as 120 and the contacts of the second group of relays 120 may each operate a third group of relays 120, as needed whereby a sufficient number of contacts are supplied for the need thereof. In this specification, where a relay is said to have more than a reliable number of contacts, a tree of relays, or other similar apparatus may be used as necessary.

The open contacts of the relay 120 prevent application of power to the corresponding solenoids 121. The plungers 122 of the solenoids 121 have on the lower end thereof, as shown in FIG. 5, a number that corresponds to the number of the button 16 that is pressed and upon actuations thereof, the plunger 122 prints on a ticket 100 its number in the place reserved for it, as mentioned above in connection with the descriptions of FIG. 3, using magnetic ink provided by the ribbon 126. Furthermore, a lead 440 is supplied from each of the lower contacts of the pairs thereof connected to the solenoids 121 to the central station by way of the cable 62 to record the numbers in the respective one of recorders 506 when the solenoids 121 are actuated, on a tape at the central station as will be explained. Further explanation of FIG. 5 will be given in connection with operation of the "bet" buttons 32.

Money Acceptance and Change Return

Figure 11:
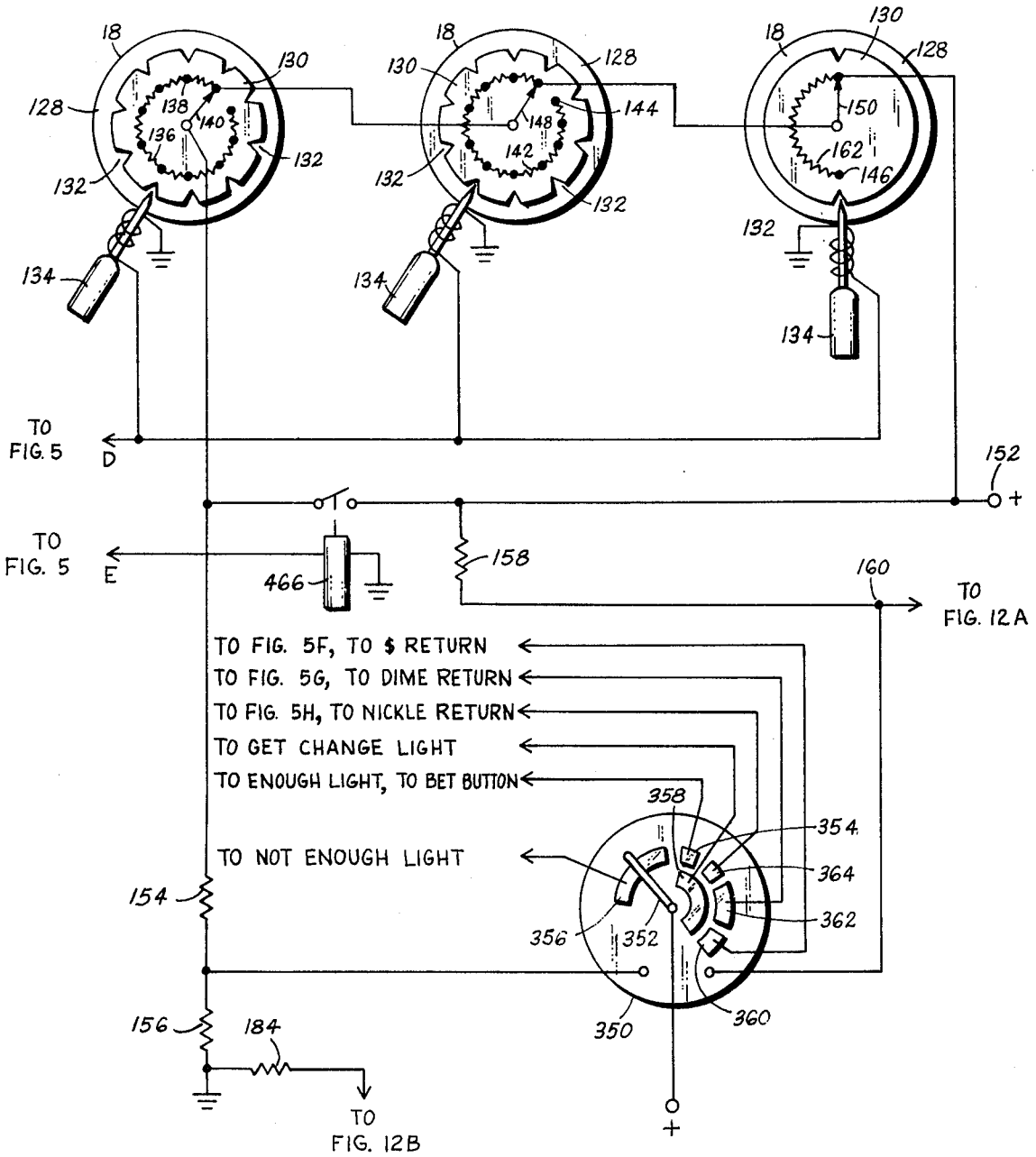
FIGS. 11 and 12 are diagrammatic views of the bet determiner, the money counter, and the change determiner.

Next, the bettor turns the wheels 18, FIG. 2, clockwise or counterclockwise until the amount of money he wants to be bet shows in the windows adjacent each wheel 18. As shown in FIG. 11, each wheel 18 has a large diameter portion 128 that extends through the top of the remote console 11, and a smaller portion 130 that has numbers on the periphery thereof that show through the windows of FIG. 2. The two left hand wheels each show the number 0 – 9 and each have ten notches 132 arranged uniformly about the periphery thereof. The right hand wheel 18 has but two notches 132 in the periphery thereof diagonally opposed. A solenoid 134 is provided for each wheel 18, the end of the solenoid 134 entering a notch 132 in the adjacent wheel 18 when the solenoid 134 is energized, stopping further rotation of the wheels 18 when a bet is made, as will be explained.

Each wheel has on one face thereof a resistor. The resistor 136 on the left hand or dollars wheel has ten contacts 138, the resistance between each contact and the next thereof being equal, except that there is no resistance connected between two of the contacts. A stationary arm 140 is provided so that as the dollar wheel 18 is rotated clockwise, the resistance between the end of the resistor 136 and the arm 140 increases in steps. The resistor 142 on the side of the middle or tens wheel 18 is similarly arranged, however each portion of the resistor 142 between the contacts 144 is one tenth of the resistance between the contacts 138 on the dollars wheel. On the cents wheel 18, only two contacts 146 are provided, the resistance between the contacts 146 being one half of the resistance between two successive contacts 144 on the tens wheel. The zero contact on the resistor 136 is connected to the arm 148 of the tens wheel 18. The zero contact on the resistor 142 is connected to the arm 150 on the cents wheel 18. The zero contact on the cents wheel 18 is connected to a terminal of a well regulated source 152.

The arm 140 is connected through a resistor 154 and through a further resistor 156 to ground. A resistor 158 is connected between the source 152 and a terminal 160. The resistor 154 and portions (or none) of the resistors 136, 142, and 162 of the dollars, tens, and cents wheels 18 depending on the positions of the wheels 18 with respect to their arms 140, 148, and 150, comprise one arm of a wheatstone bridge. The resistors 156 and 158 comprise two other arms of the bridge. The fourth one of the bridge is shown in FIG. 12.

It will be noted however, that the resistance of an arm of the bridge being described depends on the amount of the bet as set by the bettor. It will also be noted that the maximum bet is $9.95 since there are nine dollar sections on the dollar wheel, and nine ten cent sections on the tens wheel, and one five cent section on the cents wheel, and that any amount from 5¢ up in steps of 5¢ can be bet. The resistor 154 is provided so that the arm containing the wheel resistors 136, 142, and 162 cannot be zero even though each of the wheels 18 is set at zero.

Figure 12:
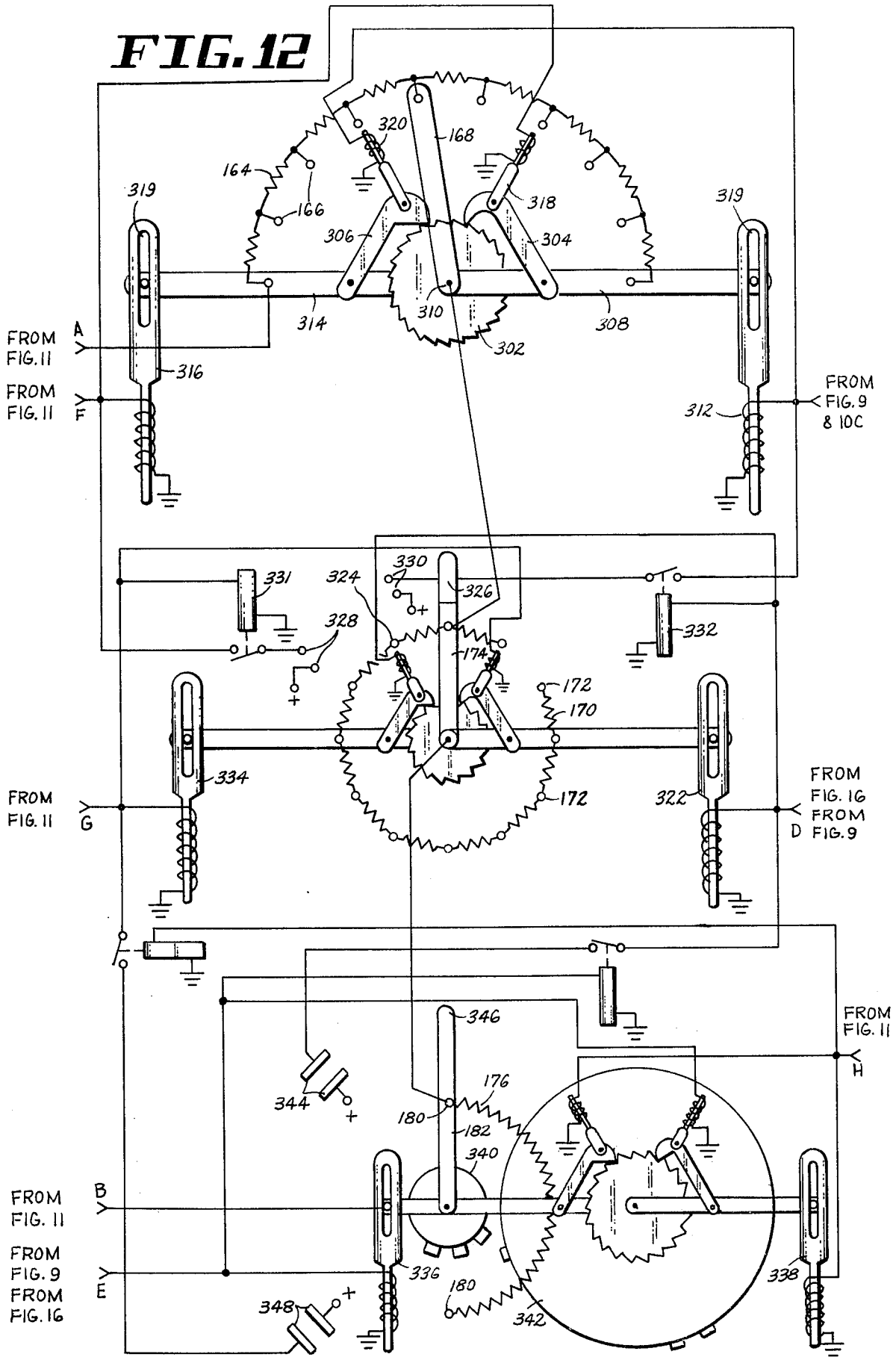

The fourth arm of the bridge of FIG. 11 is shown in FIG. 12. The terminal 160, FIG. 11, is connected to an end of a resistor 164 having 9 sections each equal to a section of the resistor 136, and ten contacts 166. An arm 168 sweeps the contacts 166 and the arm 168 is connected to an end of a resistor 170 having nine sections and ten contacts 172. An arm 174 sweeps the resistor contacts 172, the arm 174 being connected to a terminal of a resistor 176. The resistance between the adjacent contacts 172 is equal to the resistance between adjacent contacts 144, except that there is no resistance connected between one pair of adjacent contacts 172 as shown. The resistor 176 has the value of the resistors 162 and there are only two contacts 180 thereon. An arm 182 sweeps the two contacts 178. The arm 182 is connected, by way of a resistor 184 (FIG. 11) to ground. The resistors 154 and 184 have the same value. As will be further described, the wheatstone bridge of FIGS. 11 and 12 determine whether enough money is inserted into the several slots 38, 40, 42, 44, 46, 48, and 50 of FIG. 1 and, if too much money is inserted in these slots, how much change is given to the bettor.

Figures 10, 10A:
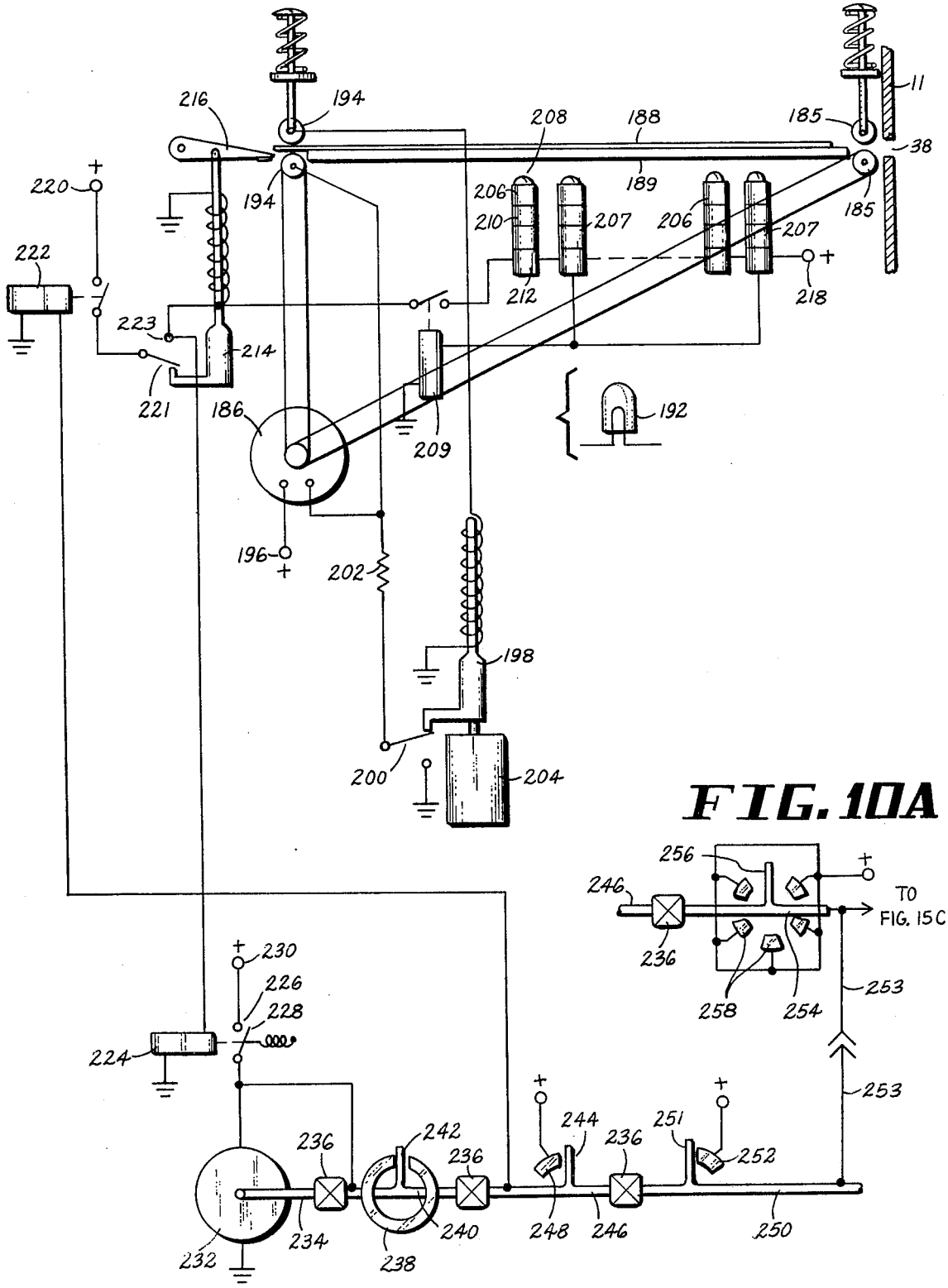
FIG. 10 is a diagrammatic view of a bill receiver which checks the bill for genuineness.
FIG. 10A is a detail of a receiver for a $5.00 bill.

Returning to FIG. 2, the bettor is informed that the next step is to put in money. He can put in $1.00 bills or $5.00 bills in slots 38 and 40 respectively and he can put coins in slots 42 – 50. Let us assume that he puts a $1.00 bill in its slot 38, see FIG. 10. The wheels 185, which are normally rotating, driven by a motor 186, move the bill 188 into the cabinet 11 over a transparent plate 189, which is illuminated in any suitable manner as by a bulb 192. When the bill 188 separates a pair of wheels 194 power is cut off from the motor 186.

The power circuit for the motor 186 is traced from power terminal 196, through the motor 186, lower wheel 194, upper wheel 194 (when the edge of the bill 188 does not separate the wheels 194) the coil of a solenoid 198 to ground, holding the solenoid coil 198 up when the motor 186 is running. When the solenoid 198 is up, the normally open switch 200 is allowed to remain open so there is no circuit from the motor terminal to ground through the resistor 202 and the switch 200. As soon as the bill 188 separates the rollers 194, the power circuit to the motor 186 is broken as is the power circuit for the solenoid 198 which starts to fall, its fall being shown by a dashpot 204. Soon the plunger of the solenoid 198 closes the switch 200 and the motor 186 starts and the solenoid 198 is raised allowing the switch 200 to open. The result is that the wheels 194 and 185 stop feeding the bill 188 for a short period of time which is long enough however to test the bill 188 to see if it is genuine.

For testing purposes, a plurality of assemblies 206 and 207 are provided. Each assembly comprises a lens 208 at one end thereof, an optical filter 210 in the assembly and a photocell 212 at the other end of the assembly. All lenses are adjacent to the transparent plate 189. The assemblies 206 are so placed that the light reaching the photocell from the bill 188, if it is genuine, will make all the respective photocell 212 conductive. However it is possible that the light reaching the photocell of an assembly 206 is too great, such as if a plain sheet of white paper is inserted in the slot 38.

The assemblies 207, which are otherwise identical to the assemblies 206, are provided to detect spots that are too bright. Upon energization of any one of assemblies 207, the relay 209 is energized to break the connection between the assemblies 206 and the solenoid 214. Therefore, even if all the photocells 208 are exposed to light of high enough intensity, the solenoid 214 cannot be energized by the photocells 206 if only one of the cells 207 indicate that a spot on the bill is too bright. That is the bill is assumed not to be genuine. If furthermore, the light falling on any photocell 212 in any assembly 206 is not such as to make the photocell conductive, it is assumed that the bill is not genuine. This test takes place during the short period that the motor 186 is not running.

Let it first be assumed that the bill is not genuine or has excessively bright spots energizing an assembly 207 or is so dirty or dilapidated that one of the photocells 206 is not made conductive. The plunger of the solenoid 214 remains stationary and the deflector 216 remains stationary and the bill 188 rides up the deflector 216, when the motor 186 is again energized, and comes out of the return $1.00 bill slot 22 on the top of the cabinet 11. However, if all the photocells 212 of assemblies 206 are made conductive, and none of the photocells or assemblies 207 are conductive, electricity will flow from source 218 through each of the photocells 212 of assemblies 208 in series, through the coil of the solenoid 214 to raise it, thereby raising the deflector 216 to deflect the bill 188 down into the console 11 where it remains until collected. As the plunger of the solenoid 214 rises it closes a source of power 220 for the solenoid 214 through the normally closed contacts of a relay 222 and also closes the switch 221 to its contact 223 and the solenoid 214 stays up, holding the deflector 216 up until the bill 188 has passed the rollers 194.

Energizing the solenoid 214 will also energize a relay 224 having normally open contacts 226 which are closed by a flapper 228 having a conductive front and an insulated back. As the flapper 228 rotates counterclockwise, when the relay 224 is energized, it touches and passes upper contact 226. In touching upper contact 226, flapper 228 connects a source 230 to start a motor 232. The shaft 234 of the motor 232 rotates at a reduced speed due to speed reducing gearing built into the motor 232. The motor shaft 234 is divided into mutually insulated sections by insulators 236. A ring like conductor 238 surrounds the first insulated section 240. An arm 242 is fixed to the sections 240 and extends into a break in the ring 238. As source of power is connected to ring 238 and the insulated section 240 is connected to motor 232.

Therefore, although the flapper 228 may be in contact with its upper contact 226 for only a short time, this time is long enough for the motor 232 to rotate the arm 242 into contact with the ring 238 and power from the source connected to the ring 238 is applied to the motor 232 long enough for the shaft 234 to rotate one revolution. During this time, an arm 244 connected to the insulated shaft section 246 contacts the arc or section 248 and applies electricity to the relay 222 to open its contacts and deenergize the solenoid 214 and relay 224. The plunger of the solenoid 214 falls and brings the deflector 216 back to its lower position as shown. As the solenoid 214 falls the switch 221 opens. Relay 224 being deenergized, the flapper 228 goes back to its open position as shown. Since the back of the flapper 228 is insulated, in going back no power is applied to the motor 232, whereby it only goes through one cycle for each bill accepted. While the shaft 234 is turning, the shaft section 250 turns and its wiping arm 251 touches contact 252 and one pulse is applied to the lead 253. As will be explained, this pulse causes the counting of $1.00.

The $5.00 machine is identical with the $1.00 machine, except that photocell assemblies 206 and 207 are positioned so as to check $5.00 bills instead of $1.00 bills and also an insulator section 254 having an arm 256 and five contacts 258, all connected to a power source, is substituted for the sections 250. Then five pulses are delivered to the shaft sections 254 and to lead 253 to indicate that a $5.00 has been accepted. Then $1.00 machine and the $5.00 machine are side by side receiving bills through slots 38 and 40 (FIG. 1) and returning unacceptable bills through slots 22 and 24 (FIG. 2), each respectively.

Figure 9:
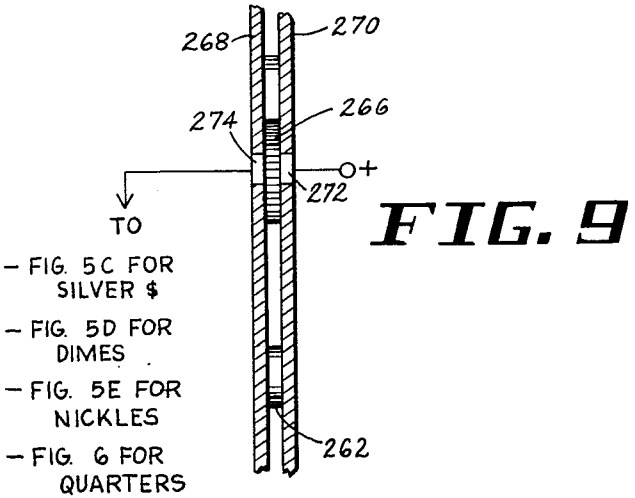
FIG. 9 is a diagrammatic view of a coin detector.
Figure 8:
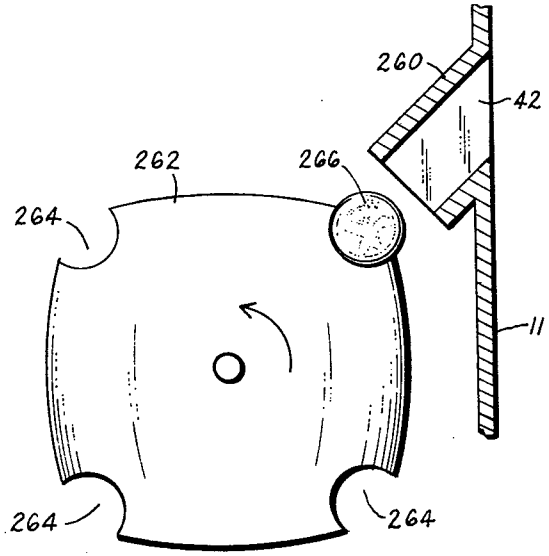
FIG. 8 is a diagrammatic view of a coin receiver.

Coins are also accepted by the remote console 11. For example, see FIGS. 8 and 9. The slot 42 for receiving silver dollars is illustrated but it is typical of all five slots 42 – 50 for receiving all coins but cents. A coin 266 here shown as a silver dollar, comes down a guide 260 of the right size for the coin to a star-like wheel 262 which rotates continuously. The wheel 262 has several pockets 264, here shown as four, into which the coin 266 is received. The leading edge of the pocket 264 is lower than the trailing edge as shown in FIG. 8 to better receive the coin 266. The wheel 262 rotates between two side plates 268 and 270 which may be of insulating material (FIG. 9). Contacts 272 and 274 are provided, one on each side of the coin 266 in the insulating side plate 270 and 268 respectively. The contact 272 is connected to a source of power as shown and the contact 274 is connected to the counting device of FIG. 12 as will be explained. If the difference in size of the coins permit, the contacts 272 – 274 may be placed off center so that a quarter (for example) put in the dollar slot will not cause contact of the contacts 272 – 274.

Figure 16:
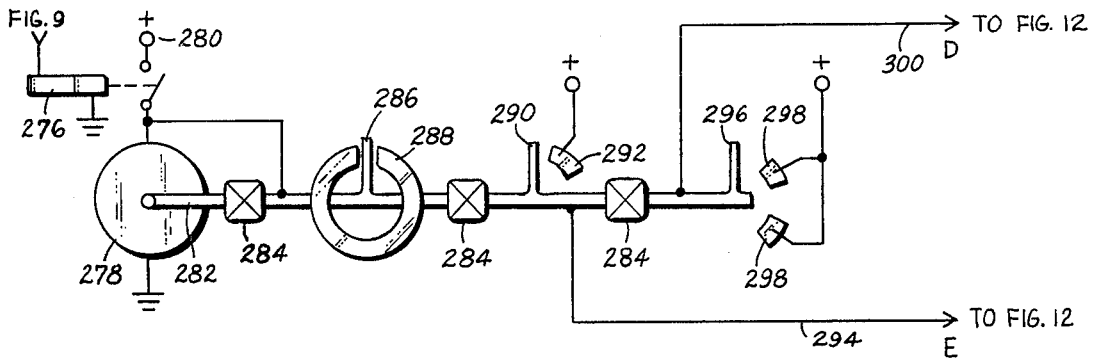
FIG. 16 is a diagrammatic showing of a pulser to be used with FIG. 12.

If the coin 266 is a dollar, a dime, or a nickel, the contact 274 does directly to the dollar, dime or nickel counter of FIG. 12. If the coin is a quarter dollar, the contact 274 is connected to a pulser that produces two pulses for the tens counter and one pulse for the cents counter of FIG. 12. Such a pulser is shown in FIG. 16. The contact 274 of FIG. 9 is connected to the relay 276 of FIG. 16 closing its contacts and causing the motor 278 to be energized by the source 280. The motor in running turns its shaft 282 which is broken up into segments by insulators 284. An arm 286 contacts a broken ring 288 and keeps the motor 278 going for one revolution of the shaft 282. Again, by use of suitable gearing, the motor 278 may turn over much faster than the shaft 282. The arm 290 wipes over a contact 292 and produces one pulse on lead 294. Similarly the arm 296 wipes over the two contacts 298 and produces two pulses on the lead 300. The lead 294 and 300 are connected respectively to the cents and tens and input terminals of FIG. 12. While no one figure shows a pulser that is suitable to provide five pulses when a half dollar coin is inserted in slot 44 of FIG. 1, such a pulser will be clear to one skilled in the art upon noting FIGS. 16 and 10A. By substituting the shaft 254 and the arm 256 and the contacts 250 of FIG. 10A for the arms 290 and 296 and their respective shaft sections and for the contacts 292 and 298 of FIG. 16, apparatus that produces five pulses when one is applied thereto is provided. The output of the so combined FIGS. 16 and 10A goes to the tens add input of FIG. 12.

The add and subtract operation of FIG. 12 will now be described. The arm 168 of FIG. 12 is fixed to a double ratchet wheel, that is a ratchet 302 at one side of the arm 168 has teeth pointed as shown to enable the hook 304 to rotate the arm 168 clockwise and another ratchet, not shown, is provided fixed to the arm 168 to enable the hook 306 to rotate the arm 168 counterclockwise. An arm 308 on which the hook 304 is pivoted rotates freely on the shaft 310 of the two ratchets. A solenoid 312 is provided to move the arm 168 clockwise between two adjacent contacts 166. Another arm 314 on which the hook 306 is pivoted rotates freely on the shaft 310. A solenoid 316 is provided to rotate the arm 168 counterclockwise between two adjacent contacts 166. Respective solenoids 318 and 320 are provided to disengage hooks 304 and 306 from their respective ratchet wheels. The solenoids 312 and 320 are connected in parallel and the solenoids 316 and 318 are connected in parallel whereby if the solenoid 312 is energized to turn the arm 168 clockwise, the solenoid 320 is energized to release hook 306 and its ratchet to permit arm 168 to turn clockwise.

Similarly if solenoid 316 is energized to turn arm 168 counterclockwise, solenoid 318 releases hook 304 and its ratchet. Slots 319 are provided in the connection between the plunger of the solenoids 312 and 316 and their respective arms to give solenoids 318 and 320 time to lift their respective hooks 304 and 306 before solenoids 312 and 316 engage their respective arms 308 and 314. Therefore each time a pulse is applied to solenoid 312 from the dollar coin receiver of FIG. 9 or from the $1.00 bill receiver of FIG. 10, or the $5.00 bill receiver of FIG. 10A, the arm 168 is advanced one contact 166 on the resistor 164. As shown, the dollar counter portion of FIG. 12 counts up to $10.00.

No description of the mechanism for rotating the arm 174 clockwise or counterclockwise appears necessary in view of the description of the mechanism for rotating the arm 168. It is noted that the contacts 172 of the resistor 170 are arranged in a circle whereby the arm 174 may rotate in either direction in an unlimited manner. If pulses are applied to the solenoid 322 from FIG. 9 to indicate a dime has been inserted in slot 48, or from lead 300, FIG. 16, to indicate a quarter has been inserted in slot 46 (the extra nickel is counted by moving arm 182 as will be described), or from FIG. 16 and FIG. 10A combined as described above to indicate a half dollar has been inserted in slot 44, the solenoid 322 will step the arm 174 the requisite number of steps. If the arm 174 goes from the last contact 324 on the resistor 170 to the first contact on the resistor 170 in a clockwise direction a conductive extension 326, which is insulated from the remainder of arm 174 connects contacts 328 together. Nothing happens since relay 331 is deenergized. The extension 326 then connects contacts 330 together. Relay 332 is energized being in parallel with solenoid 322 whereby power is applied to solenoid 312 to cause it to step forward one step, that is when arm 174 goes clockwise from last contact 324, a one is carried to cause the arm 168 to go clockwise one contact 166. Similarly when the arm 174 goes counterclockwise to contact 324, the extension in sweeping over contacts 330 does nothing since relay contacts 332 are open. However in sweeping over contacts 328, the solenoid 316 is energized to step the arm 168 counterclockwise one step since the relay 331 is energized upon energization of solenoid 334. Therefore when the arm 174 rotates counterclockwise to contact 324, a one is carried to arm 168 in a negative manner.

The cents part of FIG. 12, since the smallest coin in value that is received is a nickel whereby a whole revolution of the arm 182 must be accomplished by two pulses on either of solenoids 338 or 336, is modified to include a gearing to increase the speed of arm 182. The arm 182 is fixed to a small gear 340 which meshes into a larger gear 342 to which the two ratchet wheels (only one of which is shown) are fixed and one which the solenoids 336 and 338 operate in a manner that is clear from the description of the remainder of FIG. 12. It will be noted however, that now the solenoid 336 is the add solenoid and the solenoid 338 is the substract solenoid due to change in directions of rotation due to the use of gearing 340 and 342. Furthermore, the contacts 344 are the positive or add on carry contacts which are connected by extension 346 of arm 182 and the contacts 348 are the negative or substract carry contacts, also connected by extension 346. It is noted that contacts 344 and 348 may need to be lengthened to extend the time that power is applied to the solenoids energized therethrough due to increased speed of the arm 182. Therefore each time a nickel is inserted in slot 50 or a quarter is inserted in slot 46, a pulse is applied to solenoid 336 to cause arm 182 to make a half revolution in the clockwise direction. The change making operation of this apparatus will now be explained.

It is noted that the bettor has chosen his numbers by processing one or more buttons 16, he has set in his bet by adjusting wheels 18 and he has put money, bills or coins, in the appropriate slots. Until the money is enough to cover the bet, the "more" light 26 (FIG. 2) will be on. If the amount inserted is just right, the "enough" light 28 will be on. But more usually, the money put in is too much whereby the "get change" light 30 will go on and the mechanism will proceed to give change. As explained above, resistances 136, 142, and 162 on wheels 18 and resistance 154, FIG. 11, is one arm of a wheatstone bridge while resistor 184 and (FIG. 12) resistor 164, 170, and 176 in series is the opposite arm of the wheatstone bridge, the resistors 154 and 184 being equal. Since the other two arms of the bridge 156 and 158 are equal, the meter 350, connected across the terminals of the bridge opposite the ones to which the power supply 152 and ground are connected will read zero, that is will be in the center of the seal when the opposite arms are equal, whereby the needle or arm 352 of the meter 350 will contact the segment 354 and supply power to light the "enough" sign 28 of FIG. 2.

However if the amount of money is too small the needle 352 will be to the left of center as shown and will contact the segment 356 and light up the "more" sign 26. If the money is too much, as counted by the counter of FIG. 12, the arm 352 will contact the segment 358 to light up the "get change" light 30 and also the arm 352 will contact one of the segments 360, 362, or 364. The contact 364 will be contacted if only a nickel change is due. The contact 364 is connected to energize relay 366 of FIG. 13. Due to explanations of similar devices hereinabove it is known that momentary energization of motor 368 by relay 366 causes a single revolution of shaft 370 and therefore energization of solenoid 372 to push out one coin 374, in this case a nickel, from the stack thereof out of the slot 58 (FIG. 1) into the pocket 60 and since the section 375 of the shaft of the motor 368 is connected to the solenoid 338 (FIG. 12) the solenoid 338 will cause the arm 182 to count back 5¢. The needle 352 will now drop to contact 354 and the "enough" light 28 will go on. If the amount put in is more than enough, in the range of 15¢ to 95¢ the needle 352 will contact the segment 362. This is connected to another mechanism exactly like FIG. 13 except that the stack of coins 374 are dimes and the section 375 is connected to the solenoid 334 of FIG. 12.

If after a dime has been delivered into the cup 60, the needle 352 still contacts the segment 362, the relay 366 will remain energized and the motor 368 will complete another cycle and another dime will be delivered to the cup 60 and will be counted back in solenoid 334. When the change remaining is 5¢, the 5¢ return operation mentioned above will take place. If the change is zero, the needle will drop to contact 354, sliding along contact 364. The relay 366 is slow acting so that the mere sliding along the contact connected thereto will not energize it. Similarly, if the change is a dollar or more, the same mechanism is used, except the coins 374 are dollars and the section 375 is connected to energize solenoid 316 of FIG. 12.

Figure 14:
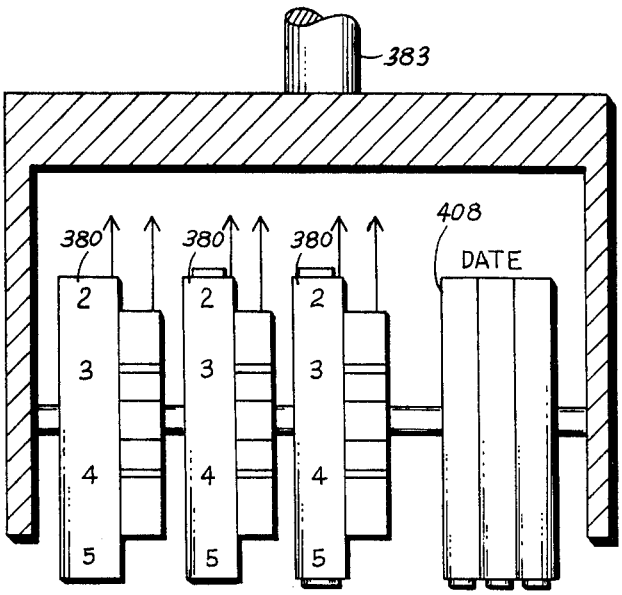
FIGS. 14 and 15 are diagrammatic views of printing wheels of FIG. 5.

In the meantime, the bet amount printing wheels 380, see FIG. 14, and also comprising the lower part of solenoid 383 of FIG. 5, record the same numbers at their bottom or printing surface as the respective wheels 18 shown in FIG. 2. While this registering of the wheels 18 and 380 may be accomplished in any known manner, the apparatus shown in FIG. 17 may be used if desired. On the side of the wheels 18 opposite the side shown in FIG. 11, another resistor 382 having nine segments and ten contacts 384 is placed. Similarly the wheels 380 has a similar resistor 386 on the side thereof. As the wheel 18 is turned in either direction by the bettor, the arm 388 corresponding to the wheel 18 stands still and sweeps over the contacts 384.

One end of resistor 382 to the arm 388 is one side of a wheatstone bridge, while the end of the resistor 386 to the arm 390 cooperating therewith, which also stands still, is the opposite arm of the wheatstone bridge and the other two opposite arms of the bridge are equal resistors 391 and 392. A meter 394 is connected from the junctions of resistors 382 and 391 to the junction of the resistors 386 and 392. If the resistance of resistor 382 to the arm 388 is equal to the resistance of the resistors 386 to its arm 390, needle 396 is between the segments 398 which are connected together. If the resistors are not equal the needle 396 will touch a segment 398 and a pulse will be applied to the solenoid 400 by way of the single pulse pulser 402. This pulsing will continue to rotate the wheel 380 in the same directions until the betting wheel 18 and the printing wheel 380 are synchronized.

The single pulse pulser 402 comprises a relay 404 energized by way of the needle 396 and one of the sectors 398. Upon closure of the contacts of the relay 404 energy is applied to the slow acting relay 406 to open its normally closed contacts, as well as to the solenoid 400. Openings of the contacts of relay 406 ends the pulse applied to the solenoid 400. However, if the solenoid 404 is still energized, a new pulse is applied to the solenoid 400 as soon as the contacts of solenoid 406 close again. This pulsing of solenoid 400 continues until the needle 396 contacts neither of segments 398. Obviously, any other means of making the printing wheels 380 show the same number as the betting wheels 18 may be used, or any known pulser may be used for pulser 402. Furthermore, the printing wheels at the central station may be kept the same as the betting wheels 18 using the described or any other known means.

Figure 15:
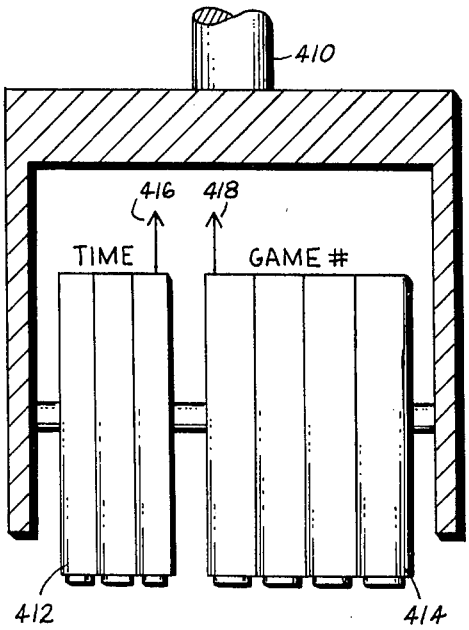

Turning back to FIG. 14, a date wheel 408, which may be set daily at each remote location is also a part carried by the solenoid 383. Furthermore, either solenoid 383 or another solenoid 410, see FIGS. 5 and 15, carries time printing wheels 412 and game number wheels 414. The time printing wheels 412 and the game number wheels 414 may be advanced over wires 416 and 418 respectively from the central station, the time wheels 412 by a master clock 505, and by a game open and a game numbering button 504 (FIG. 2A) operated by the attendant. The serial number on the ticket, if one is desired may be printed on the tickets 100 when made or may be printed on the tickets 100 by a solenoid 500 (FIG. 5) similar to solenoids 410 and 382 if desired.

Figure 7:
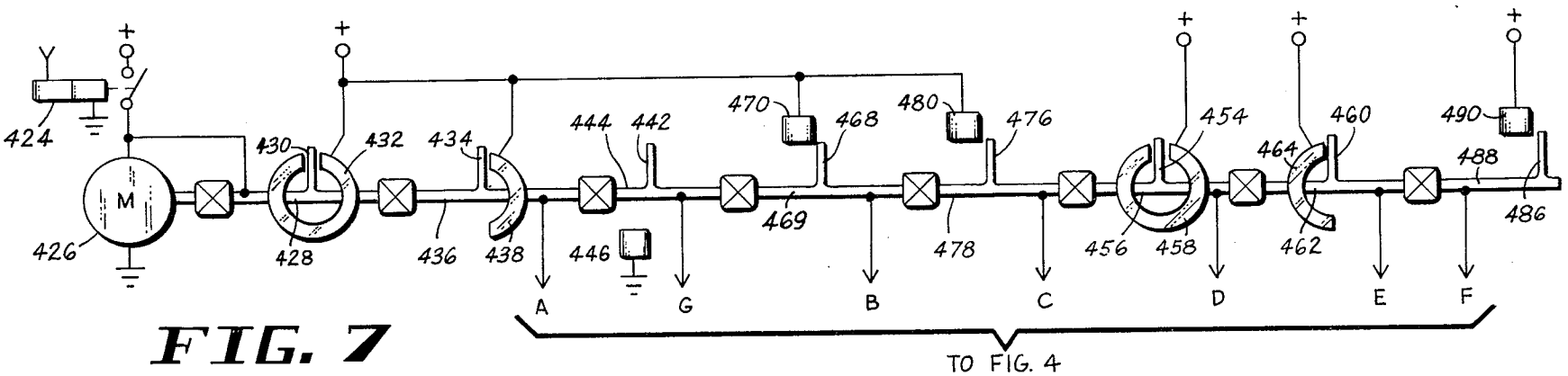
FIG. 7 is a diagrammatic view of the time switch of FIG. 5.
Figure 13:
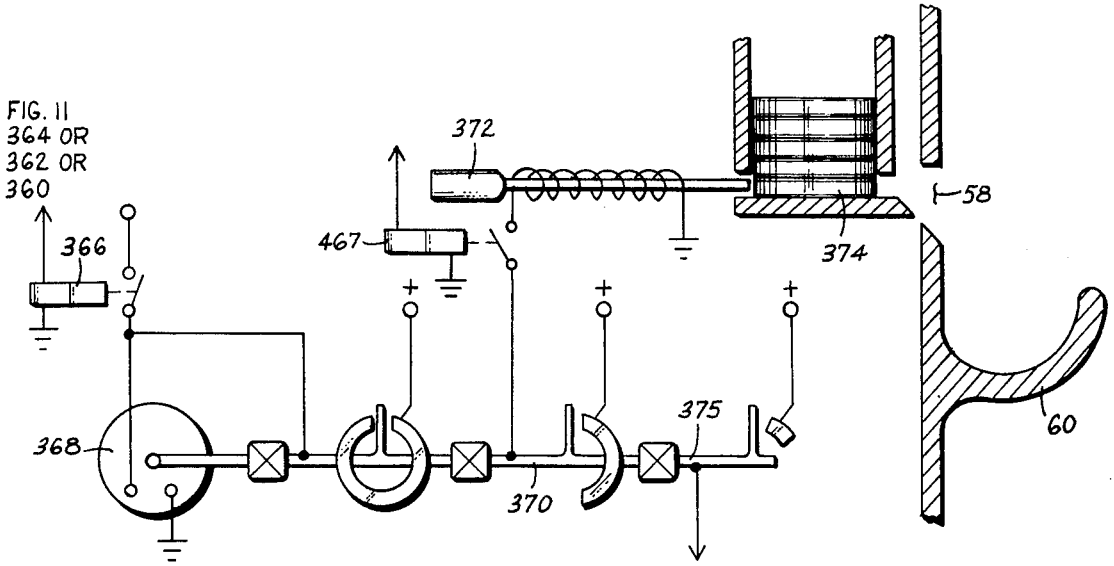
FIG. 13 is a diagrammatic showing of the change returner.

The bettor has chosen his numbers, he has chosen his bet and he has put his money in the several slots and has gotten his change. He may now press the bet button 32 (FIG. 2). If the "ready" light 34 is on and the "game closed" light 36 is off, the relay 420 (FIG. 8) will not be energized whereby its contacts will be closed. If the needle 352 (FIG. 11) is on the "enough" contact 354, power will be applied to the bet button 32 (FIG. 5) and be applied to the time switch 422 to cause it to cycle once. The details of the timing switch 422, which is similar to other timing switches such as the timing switch of FIG. 13, are shown in FIG. 7. The bet button 32 is pushed down so that the relay 424 see FIG. 7, connected to button 32 and forming part of switch 422 closes it contacts, causing the motor 426 to rotate its insulated shaft segment 428 far enough so the arm 430 contacts the ring 432 causing energy to be applied to the motor 426 regardless of whether the button 32 is held down, until the arm 430 makes one revolution and slides off the ring 432.

Several operations take place during the time the arm 430 rotates once. The arm 454, fixed to insulated segment 456, contacts ring 458 and puts power on contact D. Turning to FIG. 11 solenoids 134 are energized and the ends thereof enter corresponding notches 132 in wheels 18 to prevent any change in the bet while the ticket 100 is being printed. The arm 434, fixed to the insulated segment 436, touches sector 438 applying power to lead A. As shown in FIG. 5, lead A energizes relay 120 which energizes solenoids 500, 410, and 383 printing the amount bet, the date, the time and the game number and the serial number on the ticket 100 using magnetic ink on the ribbon 126. The numbers bet on are also printed on the ticket 100 since the relay 120 also closes all the contacts in leads 116 in series with the solenoids 121. Since however only certain ones of the numbers buttons 16 (FIG. 4) have been pressed by the bettor, only those leads 116 will have power on them from source 110 whereby only the numbers corresponding to the numbers chosen by the bettor will be printed.

Similarly, by leads 440 and cable 62, information as to what numbers are bet on go to the central station. As soon as the arm 434 leaves the sector 438 deenergizing solenoids 121, 410, 383, and 500, the arm 442 attached to insulated shaft section 444 contacts grounded sector 446 putting a ground on lead G. As seen in FIG. 5, the motor 448 is continuously energized. Its shaft is connected to a pulley 450 by a magnetic clutch comprising part of the pulley 450 and grounding lead G causes the motor 448 to turn rollers 451 to advance a ticket 100, see FIG. 6. The sector 446 is long enough to keep the magnetic clutch 450 energized until the grounded feeler arm 452 rides up the notch 102 in the ticket 100 (FIG. 6). The magnetic clutch 450 continues to drive out a ticket 100 until the arm 452 enters into the next notch 102, deenergizing the clutch 450 and stopping the rollers 451. At about the same time arm 460 attached to insulated segment 462 contacts sector 464 putting power on lead E causing relay 466, FIG. 11 to close, short circuiting the series resistors 138, 142, and 162 on wheels 18. The meter arm 352 will go to a sector 360, 362, or 364 and this will cause resistors 164 and 170 and 176 (FIG. 12) to step back to zero in the manner explained above in connection with the explanations of the change making operations.

However, to prevent operation of the change making mechanism while stepping back to zero, relay 467 of FIG. 13 is also energized for the dollar, the dime, and the nickel return machine to disable the solenoid 372 whereby when the mechanism of FIG. 12 is being reset to zero no change is given. Just before the end of the cycle of the timer of FIG. 7, the arm 468, which is fixed to the insulated segment 469, contacts the sector 470 and puts power on lead B which as shown in FIG. 5, energizes the relay 472 to energize the solenoid 474 to cut off the ticket. The bettor receives the ticket 100 through the slot 52 in the front of the cabinet 11. At about the same time, the arm 476 which is fixed to insulated segment 478 touches sector 480 energizing the relay 112 of FIG. 4 to break the holding circuits for the relays 108, whereby no button 16 of FIG. 4 will continue to be illuminated.

Finally if it is desired to number each ticket 100 serially as they are printed by the apparatus of FIG. 5, (instead of when they are manufactured) an arm 486 fixed to insulated segment 488 puts a pulse on lead F when, in its rotating the arm 486 touches the sector 490 changing the serial number on the printing end of solenoid 500. The bettor or another bettor, as soon as he sees that all button 16 lights 114 are out, and the "ready" light being on, can now make another bet.

The Central Station

Figure 19:
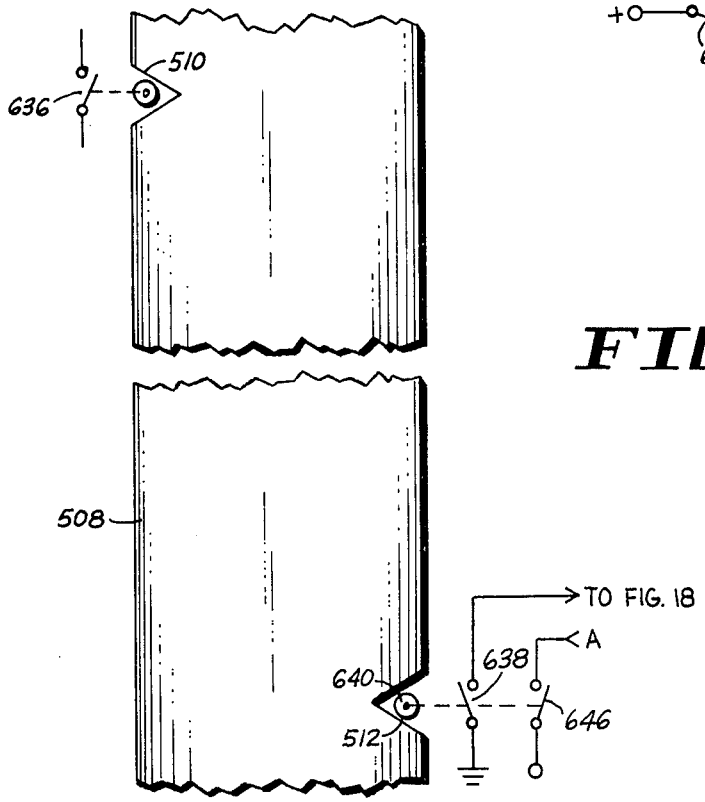
FIG. 19 is a diagrammatic view of a detail of FIG. 18.

All the information as to the numbers bet on, the amount of the bet, date, the game number, the time of day, and the serial number of the ticket must be fed back to a central station where they must be readily available to an operator. The cable 62 of FIG. 1 which extends from the remote console 11 to the operator's desk or console 77 carries this information. At the operator's desk all this information is printed by a tape recorder 506 of any known design on tape 508 of FIG. 19. As stated above, the numbers bet on arrive at the central station by way of the cable 62 on wires 440. The amount of the bet is brought to the central station by slave printing wheels, which are like wheels 380 of FIG. 14 but are at the central station, to the bet wheels 18 of FIG. 2 in any known manner, as by the manner shown in FIG. 17. The date wheels such as 408 in FIG. 14, can be set at the central and remote stations each day when the money is taken out and new ticket blanks are put in the remote stations 11. Time information and game information comes from the central station to the remote stations over leads 416 and 418 respectively, and this same information will be applied to the central station tapes 508. If ticket serial numbers are printed, the lead F of FIG. 7 is not only connected to the serial number printer 500 (FIG. 5) to change its number by one each time the printing is completed, but it will also be connected to the central station tape recorder 506 to change the number at the central station tape recorder 506. Generally, there will be one tape recorder 506 for each remote station since this makes validating the tickets easier. The mechanism at the central station will now be described.

As the numbered ball comes out of the ball selector 14, the operator presses the corresponding numbered button 79 (FIGS. 2A and 24) and the corresponding local number of the array 66 thereof as well as the corresponding remote number of the remote array 10 thereof goes on and stays on until the cancel button 80 is pressed. Mechanism similar to that shown in FIG. 4 may be used, the difference being that other lights, one in the central array 66 and the other in the remote arrays 10 are connected in parallel with the bulb (not shown) in the button that has been pressed. This is illustrated diagrammatically in FIG. 24. When a button of the array 79 thereof is pressed to indicate a number corresponding to the number on the button has come out, power is supplied to relay 514, having front contacts 516 which are closed to supply power to the corresponding light of the local display 66 and also the bulb (not shown) in the button of the array 79 thereof that has been pressed and in each of the remote displays 10, not shown, in FIG. 24. Connections to the remote arrays 10 are indicated by wires 518.

Figure 24:
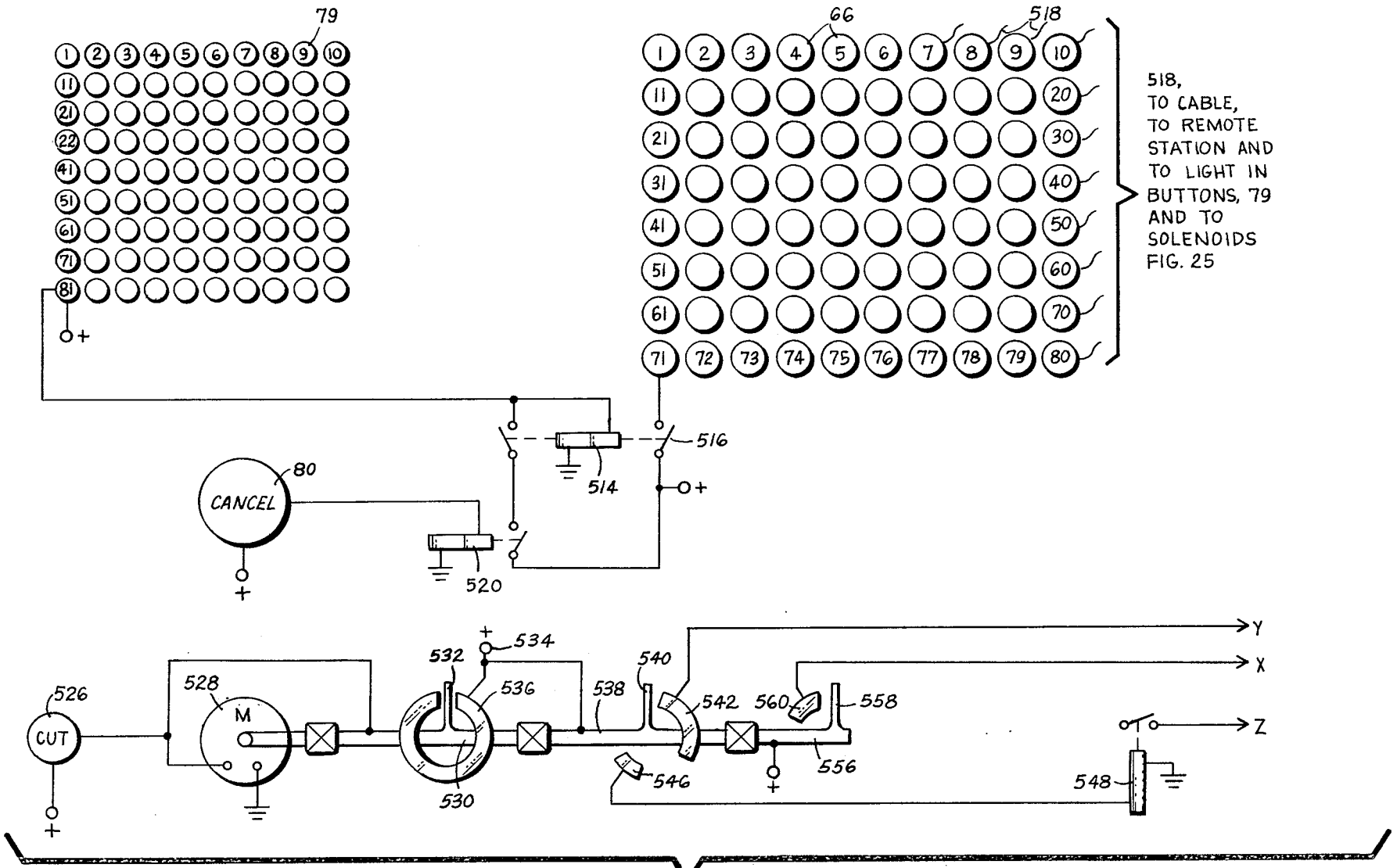
FIG. 24 is a diagrammatic showing of the winner display and winning card cutting mechanism.

At the same time, the back contacts of relay 514 are closed, forming a holding circuit for keeping relay 514 energized and holding contacts 516 closed in spite of the fact that the corresponding button of array 79 is let up. The bulbs in the buttons and in the local and remote display will stay on until the cancel button 80 is pressed to cause the relay 520 to break the holding circuit for relay 514. While only one thereof is shown in FIG. 24, as many relays 514 as there are numbers may be provided. Only one cancel button 80 is necessary and only one cancel relay 520 may be arranged to break the supply circuit for all bulbs in the buttons 79 and in the displays 66 and 10.

While the operator may leave the winning numbers of a completed game on while numbers of the next game are being bet on, all number selections must be completed before the numbers for the next game are drawn. To insure this procedure, a button 502 of FIG. 2A is provided on the console 77 which causes the game closed light 36, FIG. 2, to go on and the ready light 34 to go off at each remote console 11. This also causes relay 420, FIG. 5, to be energized to prevent anything happening when the bet button 32 is pressed by the bettor. Pressing button 502 also applies a pulse to game number wheel 414, FIGS. 5 and 15, by way of lead 418 comprising part of cable 62 to change the number of the game that will be printed on the ticket 100 when the game closed light 36 goes off and the ready light 34 goes on and the relay 420 is deenergized. The advance of the game counter 414 may be by a solenoid mechanism such as 400 and a single pulse pulser such as 402 of FIG. 17, applied however to the units wheel of game number printer 414. The game closed light is lit and stays lit and the relay 420 is energized and stays energized by a hold mechanism such as relay 108 of FIG. 4. When all the numbers are drawn for the previous game, the button 504 is pressed and the power to the game closed light 36 and to the relay 420 is cut off by a relay in the supply circuit such as 94 of FIG. 4.

Recording Mechanism

As stated above, all the information printed on the ticket 100 must be recorded at the central station. For this purpose, standard tape recorders 506 are provided at the central location, one for each remote location. In these tape recorders, there is a record 508 printed with magnetic ink of all the information printed on each ticket. Since such tape recorders are known, details thereof will not be illustrated. However, the printing mechanism may be like that shown in FIG. 5, there being no cut off mechanism such as solenoid 474 and the tape 508 (FIG. 19) for the tape recorder having no notch such as 102 of FIG. 6 but having a V shaped notch 510 near one end of the tape 508 at one edge of the tape and a notch 512 near the other end of the tape but at the opposite edge for a purpose to be disclosed.

Figure 17:
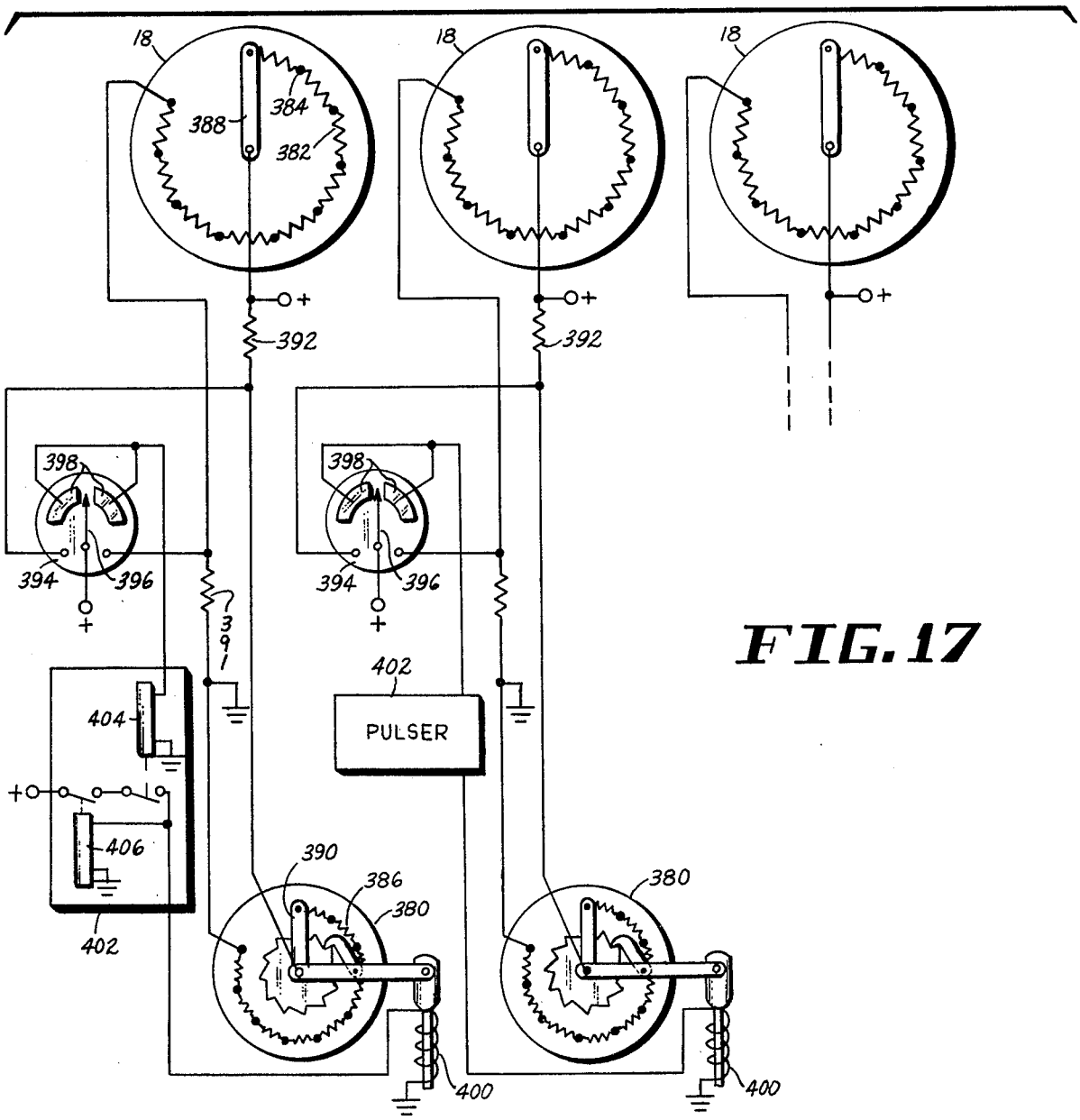
FIG. 17 is a diagrammatic showing of a synchronizer for the betting wheels and the printing wheels.

As stated above, the operator or clerk or attendant at the central station presses a button of one of the array 79 thereof on his desk 77 as a winning number comes out of the ball selector 14. It may be desirable to have cards, as many as twenty thereof, similar in shape to the card 100 of FIG. 3 cut off at the dotted lines thereof, with holes therethrough at the position where a winning number would be if one were printed on the ticket 100. Such a card, see FIG. 21, having such holes in it could be laid on a disputed ticket to prove visually to a bettor holding the disputed ticket what numbers that he bet on if any won, since the numbers bet on would coincide with a hole and show through such a card. The leads 518 of FIG. 24 not only extend to respective lights 10 as noted but they also extend individually to cutting solenoids 522 of FIG. 25 and when a button of the array 79 is pressed a corresponding solenoid 522 is energized to cut a hole in its proper position in the cards 524. A single pulse device of any known design such as 402 of FIG. 17 is connected in each lead 518 to its corresponding solenoid 522. Therefore when all the winning buttons of the array 79 have been pressed, corresponding holes are made in the cards 524 of FIG. 25.

While only four cards will be made at a time by the apparatus of FIG. 25, as many as desired may be provided by this apparatus up to the capacity thereof and further duplicate apparatus may be paralleled therewith if necessary. When all the winning numbers have been punched, the operator presses a cut button 526, which supplies power to a motor 528, FIG. 24, causing it to rotate its insulated shaft segment 530, causing the arm 532 fixed thereto to supply power from source 534 to the motor 528 until the arm slides off the ring 536 into the break thereof. The insulated section 538 rotates carrying its arm 540 and causing the arm 540 to contact the sector 542, applying power to lead Y and to the solenoid 544 in FIG. 25 causing it to punch information, such as the date and number of the game in the cards 524.

Figure 21:
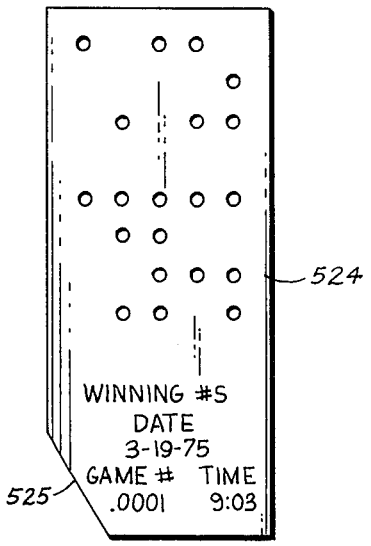
FIG. 21 is a pictorial showing of a card for checking winners.
Figure 25:
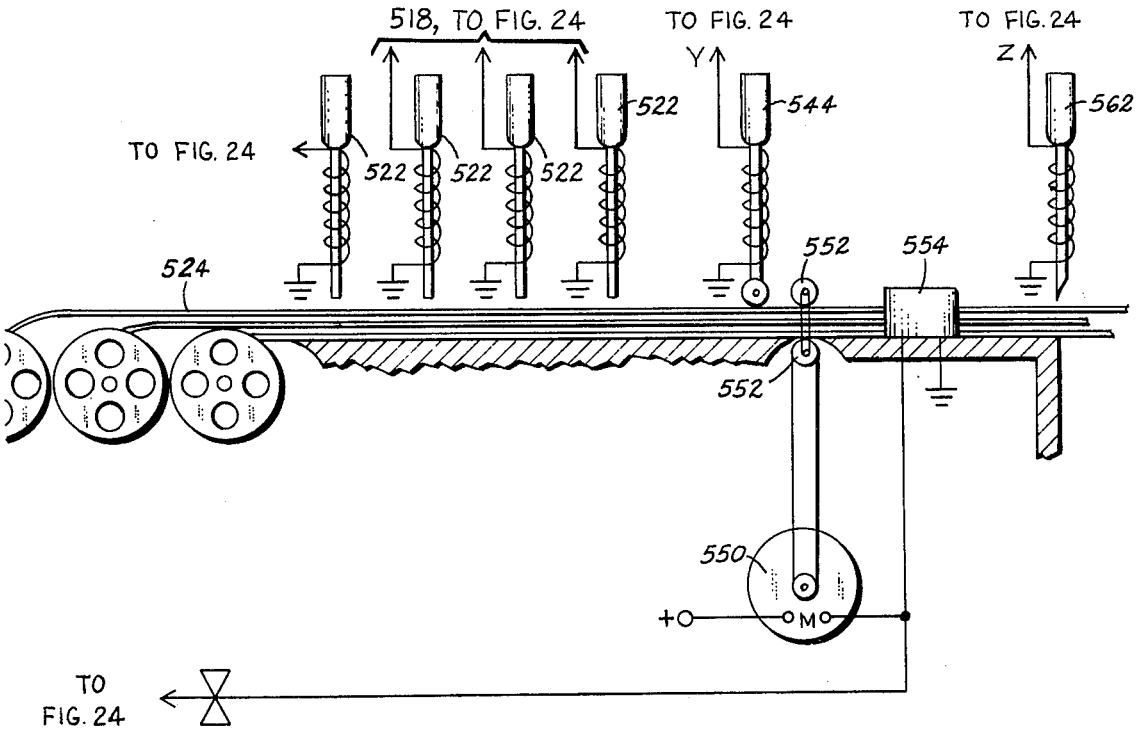
FIG. 25 is a diagrammatic showing of the winner card cutter.

As soon as all information is punched onto the cards 524 the arm 540 contacts the segment 546, power is applied to relay 548, applying a ground to motor 550 of FIG. 25 causing it to rotate and drive the rollers 552 until the notch feeler 554 rides out of its notch 525, FIG. 21. A notch feeler such as 452 of FIG. 6 may be used for feeler 554 of FIG. 25. The motor 550 runs until the card 524 presents another notch to the feeler 554 and stops. The insulated shaft segment 556 (FIG. 24) to which the arm 558 is attached contacts sector 560 and supplies power to the cutting solenoid 562, FIG. 25, to cut off the punched card 524. The information is applied to the punch portions of the solenoid 544 in the same manner that information is supplied to the printing wheels 408, 412, and 414 of FIGS. 13 and 14. The punched cards, one of which is illustrated in FIG. 21, have holes at the winning numbers of a particular game and are available to the operators to help satisfy a bettor who feels he has won even though he has been told he has not won.

Manually Inscribed Tickets

Figure 26:
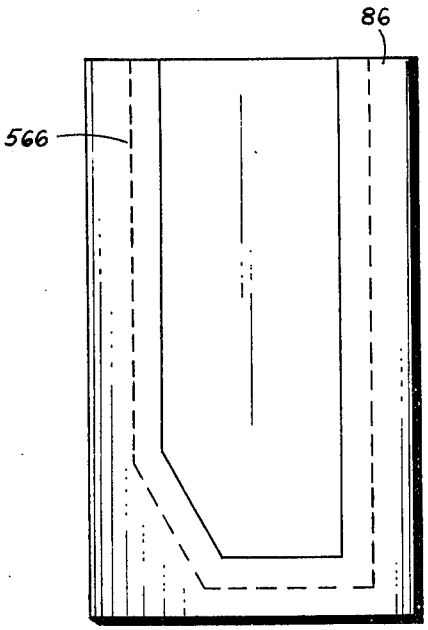
FIG. 26 is a diagrammatic showing of the winning ticket holder.

Blank betting tickets are usually readily available to bettors to indicate, at their leisure, what numbers he bets on and how much. That is, a blank ticket is one having the array of numbers, the proprietor of the game and the day thereon, but usually no time of day or game number and no amount. The bettor indicates the number bet on by encircling or otherwise indicating a number and by writing the amount bet on the ticket. The operator takes a blank ticket from his supply thereof and duplicates it and gives the duplicate to the bettor, keeping the original for his records. This operation takes considerable time. According to this invention the duplicate tickets are provided mechanically instead of manually. Blank tickets are supplied to bettor, together with supplies of writing instruments writing with magnetic ink. The bettor dabs magnetic ink on the numbers he bets on and writes in the appropriate place the amount bet. The ticket 566 (FIG. 26) so marked, with the sum bet is given to an operator who puts the ticket into the ticket holder 86 (FIGS. 2A and 26). It will be noted that due to the cut off corners of the ticket 566 and the matching portions of the ticket holder 86, the ticket cannot be put into the holder 86 incorrectly. An oscillator 568 FIG. 27, provides high frequency current for coil 570 which is positioned in the ticket holder 86 where a number is printed on the ticket 566, there being as many coils as there are possible numbers.

Figure 27:
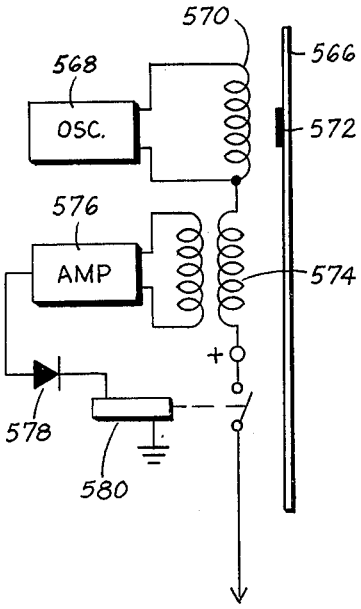
FIG. 27 is a diagrammatic showing of the ticket duplicator.
Figure 28:
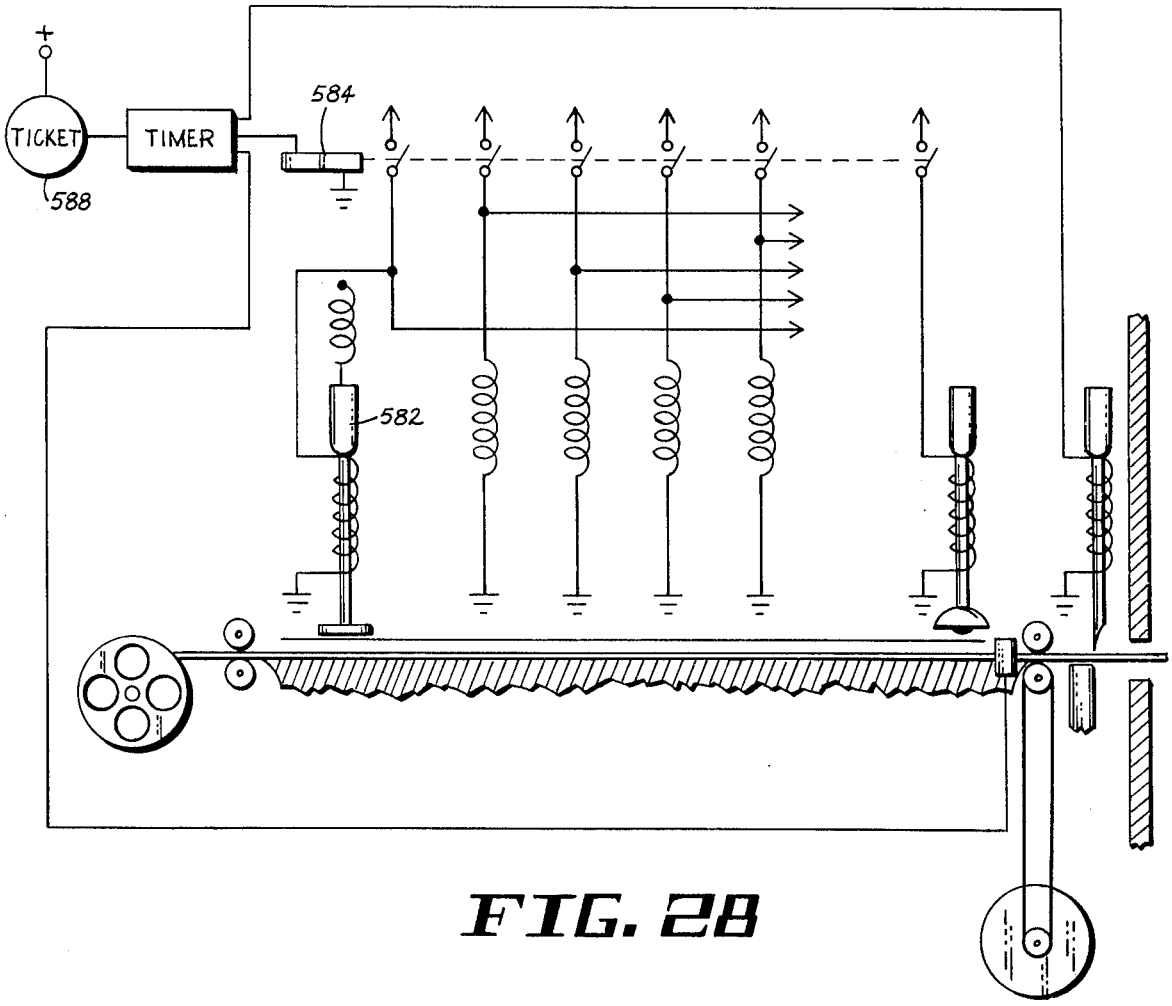
FIG. 28 is a diagrammatic showing of the duplicate ticket printer.

If that number is bet on, as indicated by the thickening 572 of the ticket 566 in FIG. 27, the amount of current flowing through the coil 570 and therefore through the coil 574 in series with the coil 570 will be changed. This changed current is applied to the amplifier 576 whose output is fed through a rectifier 578 to a relay 580. Presence of the magnetic ink 572 will cause energization of the relay 580 and power will be supplied to the number printing solenoids 582 of FIG. 28 upon closure of a relay 584. There are as many coils 570 as there are number locations on the ticket 566, each connected through contacts of a relay 580 with its respective solenoid 582. Other information that is necessary to be printed on the ticket will be done just as done in connection with the ticket printer of FIG. 5 and the records are kept in a tape recorder 506 of the information printed on the ticket printed by the machine of FIG. 28.

The operators console 77 has on the top thereof the ticket duplicator 86, the wheels to indicate amount bet 586, and the starter buttons 588. The details of the ticket printer of FIG. 28 will be known from reading the description of FIG. 5 and the Figures related thereto. As explained above, a ticket to be duplicated and recorded is put in the duplicator holder 86, the amount is set by rotating the wheels 586. When the operator has his money he presses buttons 588 and the machine provides a printed ticket at slot 88. The hand written copy is put, by the operator, into a depository for a sufficient period of time to settle any dispute that may arise.

Paying Winning Tickets

Figure 18:
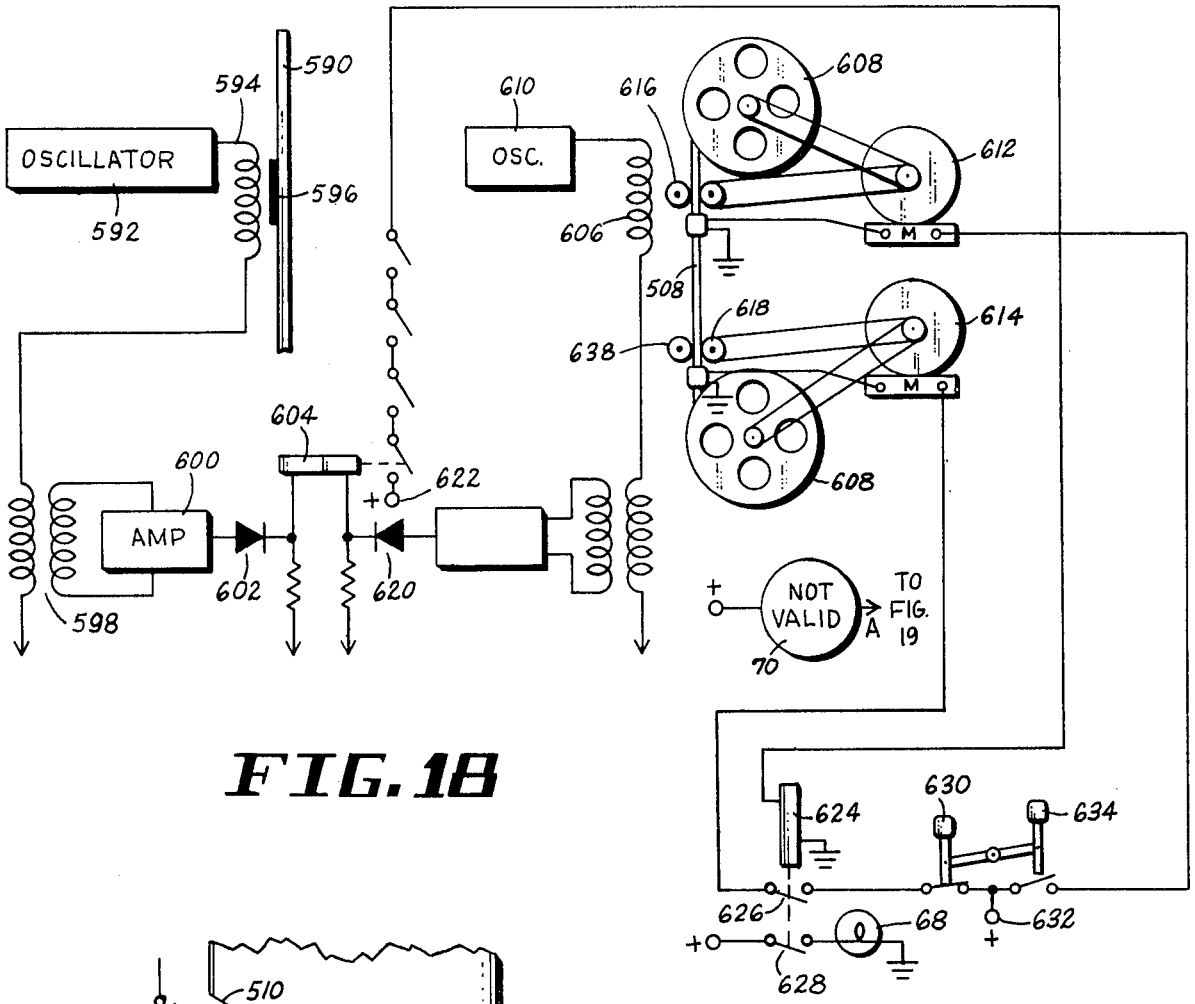
FIG. 18 is a diagrammatic view of a ticket validator.

If a bettor bets on a winning number he takes his ticket to the central station to be paid off. First however, the ticket must be validated, that is it must be proven that the marks thereon were made before the game was closed and not after the winning numbers were drawn. The ticket 590 is put in the ticket validator holder 82 on the operator's console 77. The validator holder 82 is like the duplicator holder 86. As with the holder 86, an oscillator 592 applies, by way of a coil 594 FIG. 18, high frequency waves to the spot on the ticket 590 that would have magnetic ink 596 on it if the number corresponding to that spot had been bet on. The presence of the ink 596 changes the impedance of the coil 594. The current from the coil 594 is fed into the coil 598 which is in series therewith. This current is amplified in amplifier 600 and a rectifier 602 and a relay 604 for each number spot on the ticket 590.

The tape 508 from a tape recorder 506 is stored on one or the other of two reels 608 or 610 and is run from one reel to the other by rollers 616 and 618 in a known manner. The tape 606 has the information impressed on it magnetically of each of the cards printed at a location for a game (or for longer period if desired.) The presence or absence of a magnetic record will be indicated at the output of the rectifier 620. If the information is the same the relay 604 will not be energized and its contacts will not be opened.

On the other hand, any discrepancy in information on the card 590 and on the tape 606 will cause the relay 604 to be energized and the circuit from source 622, through all the contacts of all the relays 604, to be broken to relay 624, deenergizing it. Relay 624 has two sets of contacts, contacts 626 normally closed and contacts 628 which are normally open. The contacts 626 are in series with a push button 630 which closes contacts between a source of power 632 for the wind motor 614. Another switch 634 closes contacts to supply the rewind motor 612. The two buttons 630 and 634 are so arranged that they cannot both be down or on at the same time. A feeler switch 636 in series with the rewind motor 612 supply to ground stops the rewind motor 612 when the tape 508 is fully rewound by falling into the notch 510. A feeler switch 638 in a similar manner, in cooperation with notch 512, stops the wind motor 614 when the tape 508 is fully wound. It is noted that the feeler 638 has two sets of contacts. The contacts that are open when the roller part 640 of the switch 638 is in the notch 512 is in series with the wind motor 614 and ground. The other set of contacts are closed in this position of switch 638 and is in series with the "not valid" light 70 of FIGS. 2A and 18. The "valid" light 68 is in series with the contacts 628 of relay 624.

The operations of the validator is as follows: The operator puts a card to be validated in the validator card holder 82 and he presses the button 630 starting the wind motor 614 by way of the closed feeler switch 638. Tape 508 is fed from roll 608 to roll 610 by rollers 618 whereby the tape 508 goes by the array of coils 606 for the oscillator 610. As long as there is no complete correspondence between the magnetic ink 596 on the card 590 and the magnetic ink on the tape 508, one of relays 604 (only one of the many thereof being shown) will be energized to keep its corresponding contacts open and no power will be applied to relay 624. As soon as there is complete correspondence between card 590 and a portion of tape 508 on which the information that is on card 590 is magnetically impressed, all relays 604 will be deenergized and relay 624 will be energized to stop motor 614 and to close contacts 628 to energize "valid" light 68. If however the end of the tape 508 (except for the blank portions that is fixed to reel 608) is reached without any stopping of the motor 614, the feeler 640 of feeler switch 638 will drop into notch 512, stopping the motor 614 and closing the contacts 646 of feeler switch 638 to turn on the "not valid" light 70. In either case, the operator then presses buttons 634 to supply energy to rewind motor 612 to rewind the tape on reel 608. The rewind motor 612 is stopped when feeler 636 opens when its arm falls into notch 510. The notches 510 are in opposite edges of the tape 508 so they perform their functions without mutual interference.

Having validated a ticket 590, the winnings if any must be calculated. The validated ticket 590 is put into ticket holder 84, see FIGS. 2A and 20, which resembles ticket holder 82 but in addition to a reader to determine which numbers were bet on as will be explained, the ticket holder includes known apparatus 646 for reading the amount of the bet. (Since the bet is printed in magnetic ink, the bet reader may be of the well known form used for example by banks to determine the account on which a check is drawn). The reading of the amount by the reader 646 is fed to the multiplier 648 of FIG. 23.

Figure 22:
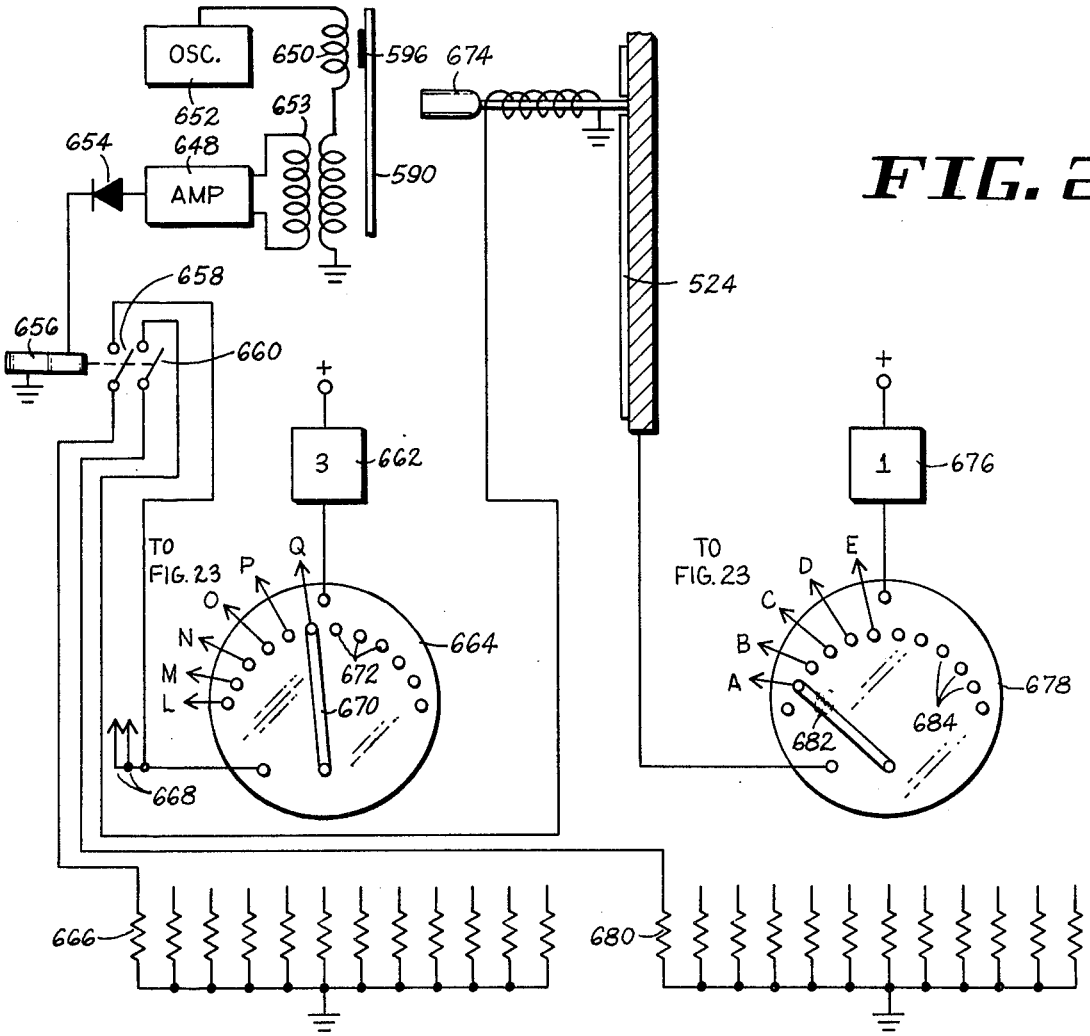
FIG. 22 is a diagrammatic view of apparatus for checking winners.

As shown in FIG. 22, the card 590 having magnetic ink 596 on it is positioned adjacent to coil 650 to which high frequency energy from an oscillator 652 is fed. The amount of energy going through the coil 650 is changed if there is magnetic ink adjacent thereto, whereby the energy fed to the coil 653 is also changed. The energy is amplified by amplifier 648 and rectified by rectifier 654 and fed to relay 656 to close both pairs of contacts 658 and 660 thereof. A circuit is completed from a source through the digital ammeter 662, the ammeter 664, the relay contacts 658, and a resistor 666 of an array thereof to ground. The number that shows on digital ammeter 662 is the number of numbers bet on. (The face of the digital ammeter 662 shows at the right of element 72 of FIG. 1.)

The reason for this is, that there is a coil 650 for each possible number on card 590 and a relay 656 for each coil and all the current in the circuits closed by all the relays 656 closing their contacts 658 goes through both the digital meter 662 and the meter 664 and a resistor 666 of the array thereof. This is indicated by the leads 668, which go to separate contacts 658 and separate resistors of the array which includes resistor 666. Therefore, if six numbers were bet on, six relays 656 would be energized and current would flow through six resistors 666 and the meter 662 would show a six and the arm 670 of meter 664 would contact the contact of meter 664 corresponding to six. The contacts 672 are connected to the respective elements in FIG. 23 as will be explained.

The total number of winning numbers is also determined in FIG. 22. In this figure one of the holed cards of FIG. 21, the holes being at the positions of the winning numbers, is placed on a conductive plate and the holes thereon are felt by feeler 674. When a feeler 674 feels a hole in the card, a circuit is completed from power to digital ammeter 676, through ammeter 678 to the second contact 660 of relay 656, which corresponds to the same number as the feeler 674 corresponds to, to one of the resistors 680 of the array thereof. If a winning number on the perforated card is not bet on, its relay, such as 656, will not be energized and no current will flow through meters 676 and 678 for a winning number that is not bet on. If more than one winning number has been bet on, that is if more feelers 674 are in series with contacts of energized relays 656, more current will flow through meters 676 and 678 to other resistors of array 680 and the meter 676 will show the number of winning numbers. The face of meter 676 shows as the left hand number of element 72 of FIG. 1. The meter arm 682 takes a position to contact a contact 684 of meter 678 corresponding to the number of winning numbers bet on, the contacts being connected to elements in FIG. 23.

Figure 23:
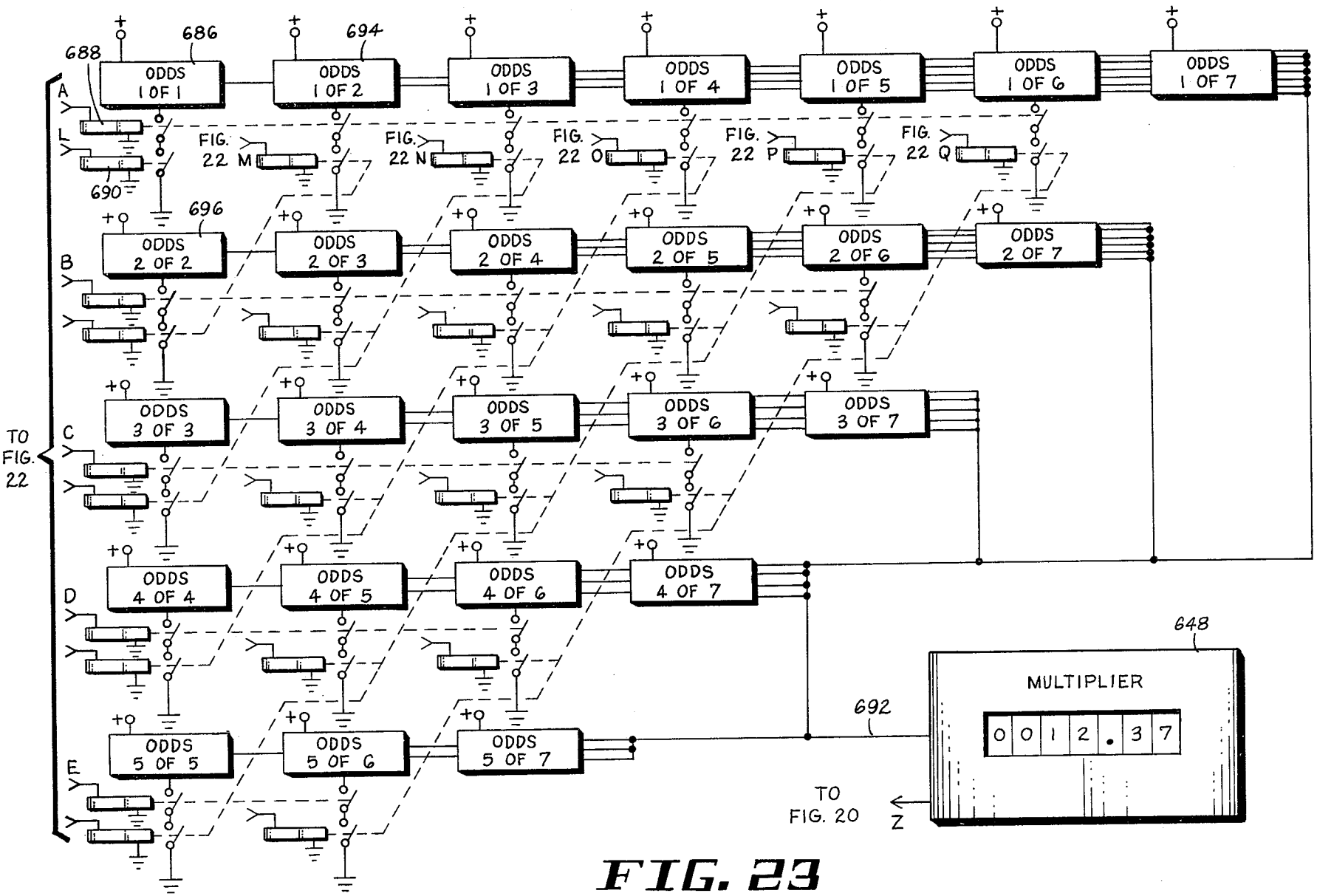
FIG. 23 is a diagrammatic showing of apparatus for finding the odds and the amount of winnings.

The odds are figured and the winnings are determined by the apparatus of FIG. 23. As noted above, the odds are determined by the management of the game and they depend on the number of winners out of the total number of numbers bet on. In FIG. 23 an array of odds determiners 686 are provided. For convenience they are arranged in rows and in columns. The top row reads from left to right, 1 of 1, 1 of 2, 1 of 3, and so forth. Each odds determiner supplies its odds, as a number which may be whole or decimal or both whole and decimal to the multiplier 648 to which the amount bet is being fed by the bet reader 646 of FIG. 20 as explained above. Multipliers are well known and are part of any computer including most hand held calculators so its details need not be explained.

Each odds determiner 686 is energized to supply a number to the multiplier 648 when the two relays 688 and 690 are both energized, only one of the odds determiner being energized for any one card. This is accomplished since the contacts 684 of meter 678 is connected to the proper relays of FIG. 23. That is, if there is no winner there is no connection of any contact on meter 678 to any odds determiner in FIG. 23 and no number or a zero is applied from the array of odds determiner to input 692 of multiplier 648, whereby a zero shows in its face. The face of multiplier 648 is seen at 74 in FIG. 1. Similarly if there is one winner, the corresponding contact A of meter 678 energizes the relay 688 of FIG. 23 connected to all odds determiner for one winner, in this case all the relays in the top row. That is, all the contacts of relay 688 are closed to close one pair of contacts for each odd determiner for one winner. However no odds determiner is energized since these are two sets of contacts in series with each odds determiner, as shown. The contacts 672 of the meter 664 are connected to corresponding relays of FIG. 23 to energize it.

For example, the contact L of meter 664 is contacted by its arm 670 when only one number is played. Then the relay 690 closes its contacts to energize the 1 of 1 odds determiner 686 since there was only one number played and it won. If two numbers had been played, contact M would have caused relay 692 to be energized. Since there was one winner both sets of contacts for odds determiner 694 would be closed and it would apply a number to lead 692 of multiplier 648. Furthermore, energization of relay 692 closes the lower set of contacts for odds determiner 696 since two numbers were played. It will be understood that the right one of the odds determiners of FIG. 23 would be energized for any possible number of winners out of any number of numbers played and only one odds determiner of the array thereof in FIG. 23 would be energized by one card.

It is usual to have a totalizer to determine how much is bet. For this purpose, the betting wheels 18 at remote stations and 586 at the local station is connected to add their reading into the adding machine at 76 of FIG. 1. To total the winnings, the output of the multiplier 648 can be both electrical as well as visual and its electrical output will be applied to an adding machine at 78 in FIG. 1 to show the total winnings.

DESCRIPTION OF AN ALTERNATE EMBODIMENT

This invention contemplates using a programmed digital computer recorder in lieu of the tape recorders 586. Digital computer recorders are now well known and available to the public as the products of several manufacturers. In accordance with this embodiment the computer will be programmed to the odds set by a particular casino. It will also include a memory bank which receives data from the remote stations and also from the manually marked tickets 566 and identification of balls selected.

When a game is closed the computer prints what amounts to a duplication of each winning ticket displaying the date, time, number of the game, and the serial number of the ticket. It also exhibits the winning numbers, the amount bet and the total amount of money won by that ticket. The computer will also print one or more copies of a sheet showing the total amount of money bet on that game and the total amount of money won by the various players on that game. This sheet is provided for the convenience of the supervisor who monitors the operations at the central station. As many copies of this sheet as are deemed necessary may be provided by way of the well known duplicators now available.

After printing duplicates of the winning tickets and the sheet aforesaid, the memory bank is erased and the computer is ready to receive information for the next game. In addition to being programmed on the odds, the computer may also be programmed on a particular date.

Figure 29:
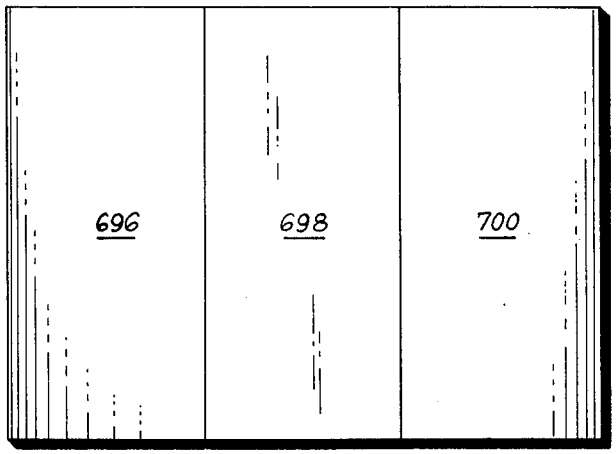
FIG. 29 is a schematic view of an alternate embodiment of the recording mechanism at the central station.

This embodiment is illustrated schematically in FIG. 29. Thus a digital computer 696 which includes or has attached thereto a printout device 698 which prints the duplicate winning tickets and the totals sheet above described. A duplicator for the totals sheet is represented at 700.

Having described the invention in detail hereinabove, the inventive features are recited in the appended claims.

What is claimed is:

1. In an automated Keno game system, a. at least one remote station having a player operated console for repeated player actuation comprising, I. means to select numbers by a player from a group of eighty on which a player wishes to bet, II. means to indicate the amount of money to be bet on the numbers selected, III. a device to accept money in the form of bills and change to cover the amount bet, IV. means to return change when the amount of money deposited for acceptance is in excess of the amount of the bet, V. a supply of tickets, VI. mechanism to impress on a ticket the numbers selected for a bet; the amount of the bet, the date on which the bet is made and the number of the game of that date for which the bet is made on final player actuation at the console of a bet button, and VII. means for issuing said ticket which is so impressed; and b. a central station having an overall game operator's console connected to said remote station, including, I. means for making a record of the numbers selected at a remote station, the amount bet on the numbers selected by the player, the date and time of selecting the numbers and the number of the ticket that is issued at said remote station, II. a ticket validator for comparing a ticket issued at said remote station when inserted into said operator's console with recording mechanism to determine that said ticket was issued by said ticket-issuing means, III. a winning numbers selecting machine in which a predetermined number of numbers from said group of eighty are determined by chance for a particular game;

IV. means for printing on a validated winning ticket the amount of money won as determined by the number of numbers of the group selected which come out in the operation of the winning numbers selecting machine, and a predetermined table of odds, and V. a cashier's station at which a bettor receives the amount of money won by his play of a winning ticket for a particular game.

2. The Keno game system of claim 1 in which the recording mechanism at the central station takes the form of a digital computer which is programmed to said table of odds and which includes a memory bank connected to said remote station, a recorder for marking a record of tickets on which bets have been made, and means for duplicating winning tickets.

3. The Keno betting system of claim 2 in which the computer determines the total amount of money bet on each game and the total amount of money won by bettors on that game, together with means to print said totals on a sheet.

4. The Keno betting system of claim 3 together with a copier at said central station for making a desired number of copies of said sheet.

5. The Keno betting system of claim 1 together with a supply of tickets which are available to a bettor who manually inscribes on a ticket the numbers he selects and the amount bet and presents said ticket at the cashier's station together with money to cover his bet together with a ticket duplicator at said cashier's station for said manually inscribed ticket.

6. The Keno betting system of claim 5 in which the recording mechanism is a digital computer recorder including a memory bank that is connected to said remote station and to the ticket duplicator at the cashier's station where manually inscribed tickets are duplicated, said computer being programmed to said table of odds, together with means associated with said computer to print duplicates of winning tickets and the totals of money bet and money won in each game on a sheet.

* * * * *